US011460050B2

(12) United States Patent
Shampine

(10) Patent No.: US 11,460,050 B2
(45) Date of Patent: Oct. 4, 2022

(54) PRESSURE EXCHANGER MANIFOLDING

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 361 days.

(21) Appl. No.: 16/099,267

(22) PCT Filed: May 8, 2017

(86) PCT No.: PCT/US2017/031491
§ 371 (c)(1),
(2) Date: Nov. 6, 2018

(87) PCT Pub. No.: WO2017/193116
PCT Pub. Date: Nov. 9, 2017

(65) Prior Publication Data

US 2019/0145237 A1 May 16, 2019

Related U.S. Application Data

(60) Provisional application No. 62/332,841, filed on May 6, 2016.

(51) Int. Cl.
*F04F 13/00* (2009.01)
*F04B 23/04* (2006.01)
(Continued)

(52) U.S. Cl.
CPC ..... *F04F 13/00* (2013.01); *E21B 43/26* (2013.01); *F04B 23/04* (2013.01); *F04F 1/08* (2013.01); *F04F 1/10* (2013.01)

(58) Field of Classification Search
CPC .... F04F 1/06–12; F04F 1/18–20; F04F 13/00; F04F 99/00; F04B 23/04; E21B 43/26
(Continued)

(56) References Cited

U.S. PATENT DOCUMENTS 2,766,928 A * 10/1956 Boszormenyi ..... F04F 13/00 417/64
2,901,163 A * 8/1959 Waleffe ..... F04F 13/00 417/64
(Continued)

FOREIGN PATENT DOCUMENTS

WO 2012026827 A1 3/2012
WO 2014018585 A1 1/2014
WO 2016018631 A1 2/2016

OTHER PUBLICATIONS

International Search Report and Written Opinion issued in International Patent Appl. No PCT/US2017/031491 dated Sep. 27, 2017; 27 pages.
(Continued)

*Primary Examiner* — Alexander B Comley

(57) ABSTRACT

An apparatus having a plurality of pressure exchangers. Each pressure exchanger includes a first conduit and a second conduit and is operable for pressurizing a low-pressure dirty fluid via a high-pressure clean fluid. Each first conduit conveys the high-pressure clean fluid into a corresponding one of the pressure exchangers and to an adjacent one of the pressure exchangers, and each second conduit conveys a pressurized dirty fluid out of a corresponding one of the pressure exchangers and from the adjacent one of the pressure exchangers. The first conduits collectively form at least a portion of a high-pressure clean fluid manifold distributing the high-pressure clean fluid among the pressure exchangers, and the second conduits collectively form at least a portion of a pressurized dirty fluid manifold com-
(Continued)

bining pressurized dirty fluid collectively discharged from the pressure exchangers.

14 Claims, 16 Drawing Sheets

(51) Int. Cl.
*F04F 1/10* (2006.01)
*F04F 1/08* (2006.01)
*E21B 43/26* (2006.01)

(58) Field of Classification Search
USPC ..... 417/64, 92
See application file for complete search history.

(56) References Cited

U.S. PATENT DOCUMENTS 3,158,007 A * 11/1964 Kentfield ..... F04F 13/00 417/64
3,232,334 A * 2/1966 Barnes ..... F04F 13/00 165/7
3,374,942 A * 3/1968 Seippel ..... F04F 13/00 417/64
3,431,747 A * 3/1969 Hashemi ..... C02F 1/22 62/123
4,887,942 A * 12/1989 Hauge ..... F04F 13/00 417/64
5,899,272 A 5/1999 Loree
5,988,993 A * 11/1999 Hauge ..... F04F 13/00 417/365
6,540,487 B2 * 4/2003 Polizos ..... F04B 1/2042 417/65
7,201,557 B2 * 4/2007 Stover ..... F04F 13/00 415/104
7,997,853 B2 8/2011 Pique et al.
8,601,687 B2 * 12/2013 Ochoa ..... F04B 53/14 29/888.042
8,622,714 B2 * 1/2014 Andrews ..... F04B 7/0023 417/64
9,945,210 B2 * 4/2018 Theodossiou ..... E21B 43/267
2006/0037907 A1 * 2/2006 Shumway ..... F04F 13/00 210/416.1
2010/0014997 A1 * 1/2010 Ruiz del Olmo ..... F04F 13/00 417/399
2013/0284455 A1 * 10/2013 Kajaria ..... E21B 43/26 166/379
2014/0128655 A1 * 5/2014 Arluck ..... B01D 53/18 585/860
2014/0284262 A1 * 9/2014 Giraud ..... B01D 61/06 210/416.1
2015/0096739 A1 * 4/2015 Ghasripoor ..... E21B 43/16 166/105
2015/0184502 A1 * 7/2015 Krish ..... E21B 43/26 166/250.01
2015/0292310 A1 * 10/2015 Ghasripoor ..... F04F 13/00 166/250.01
2016/0032691 A1 * 2/2016 Richter ..... E21B 43/267 166/250.01
2016/0032702 A1 * 2/2016 Gay ..... E21B 43/16 137/14
2016/0039054 A1 * 2/2016 Ghasripoor ..... F04F 13/00 92/172
2016/0062370 A1 * 3/2016 Gaines-Germain ..... F04F 13/00 366/152.2
2016/0160889 A1 * 6/2016 Hoffman ..... F04F 13/00 60/487
2016/0160890 A1 * 6/2016 Anderson ..... F04F 13/00 92/61

OTHER PUBLICATIONS

International Preliminary Report on Patentability issued in International Patent Application No. PCT/US2017/031491 dated Nov. 15, 2018, 24 pages.

* cited by examiner

PRESSURE EXCHANGER MANIFOLDING

CROSS-REFERENCE TO RELATED APPLICATIONS

This application claims priority to and the benefit of U.S. Provisional Application No. 62/332,841, titled "Pressure Exchanger Manifolding Methods," filed May 6, 2016, the entire disclosure of which is hereby incorporated herein by reference.

BACKGROUND OF THE DISCLOSURE

High-volume, high-pressure pumps are utilized at wellsites for a variety of pumping operations. Such operations may include drilling, cementing, acidizing, water jet cutting, hydraulic fracturing, and other wellsite operations. The success of the pumping operations may be related to many factors, including physical size, weight, failure rates, and safety. Due to high pressures and abrasive properties of certain solids laden fluids (i.e., dirty fluids), sealing components and other portions of the pumps exposed to such dirty fluids may become worn or eroded, resulting in severe damage and/or failures during pumping operations. Interruptions in pumping operations may reduce the success and/or efficiency of the pumping operations, effects of which may reduce hydrocarbon production of a well. In some instances, the pumping operations may have to be repeated at substantial monetary costs and loss of production time.

Thus, instead of pumping a dirty fluid via the high-pressure pumps, rotary pressure exchangers may be utilized to divert the dirty fluid away from the high-pressure pumps. Rotary pressure exchangers provide a way to exchange pressure energy between two fluid flows without mixing the fluids. For example, a non-abrasive solids-free fluid (i.e., clean fluid) may be pressurized by high-pressure pumps, while the pressure exchangers, located downstream from the high-pressure pumps, transfer the pressure from the high-pressure clean fluid to a low-pressure dirty fluid. The pressurized dirty fluid may then be injected into the wellbore.

Rotary pressure exchangers may be utilized to pressurize dirty fluids for injection into the wellbore. However, rotary pressure exchangers depend on very close clearances (e.g., about 0.002 inch) in order to function efficiently. Because of such clearances, rotary pressure exchangers may be inordinately sensitive to strain in their attachments and to movements of their housings. Furthermore, rotary pressure exchangers have limited individual flow rates (e.g., about eight barrels per minute (BPM)) and have to be manifolded or otherwise fluidly connected together to collectively produce high flow rates utilized during downhole pumping operations, such as during hydraulic fracturing.

Manifolding a plurality of rotary pressure exchangers is challenging as each pressure exchanger comprises four flow ports that have to be piped to various wellsite equipment. Two of the flow ports are exposed to high pressures (e.g., ranging between about 5,000 pounds per square inch (PSI) and about 15,000 PSI) and two of the flow ports are exposed to relatively low pressures (e.g., ranging between about 60 PSI and about 100 PSI). The low-pressure flow ports may be fluidly connected using flexible conduits. However, fluidly connecting the high-pressure ports necessitates use of rigid piping, which is difficult to align with the ports, resulting in stresses being transferred or otherwise imparted to various portions of the pressure exchangers during assembly and pumping operations. Furthermore, the rigid piping may transfer vibrations to the pressure exchangers during pumping operations, resulting in additional stresses being imparted to the pressure exchangers.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including multiple pressure exchangers. Each pressure exchanger includes a first conduit and a second conduit, and is operable for pressurizing a low-pressure dirty fluid via a high-pressure clean fluid. Each first conduit conveys the high-pressure clean fluid into a corresponding one of the pressure exchangers and to an adjacent one of the pressure exchangers. Each second conduit conveys a pressurized dirty fluid out of a corresponding one of the pressure exchangers and from the adjacent one of the pressure exchangers. The first conduits collectively form at least a portion of a high-pressure clean fluid manifold distributing the high-pressure clean fluid among the pressure exchangers. The second conduits collectively form at least a portion of a pressurized dirty fluid manifold combining the pressurized dirty fluid collectively discharged from the pressure exchangers.

The present disclosure also introduces an apparatus including a pressure exchanger operable for transferring pressure from a high-pressure fluid to a low-pressure fluid. The pressure exchanger includes a housing, a rotor disposed within the housing and having multiple chambers extending between opposing first and second ends of the rotor, and a first head disposed at the first end of the rotor. The first head includes a first fluid passage extending between first and second external openings in the first head, and a second fluid passage fluidly connecting the first fluid passage with consecutively changing ones of the chambers at the first end of the rotor in response to relative rotation between the rotor and the first head. The pressure exchanger also includes a second head disposed at the second end of the rotor. The second head includes a third fluid passage extending between third and fourth external openings in the second head, and a fourth fluid passage fluidly connecting the third fluid passage with the consecutively changing ones of the chambers at the second end of the rotor in response to the relative rotation between the rotor and the second head.

The present disclosure also introduces a method including coupling multiple pressure exchangers to form a fluid manifold assembly. Each pressure exchanger includes a first head having a first fluid passage extending between opposing sides of the first head, a second head having a second fluid passage extending between opposing sides of the second head, and a rotor between the first and second heads. Coupling the pressure exchangers includes fluidly connecting the first fluid passages of the pressure exchangers to collectively form at least a portion of a high-pressure clean fluid manifold of the fluid manifold assembly, and fluidly connecting the second fluid passages of the pressure exchangers to collectively form at least a portion of a high-pressure dirty fluid manifold of the fluid manifold assembly. The method also includes fluidly connecting the high-pressure clean fluid manifold with clean fluid pumps, and fluidly connecting the high-pressure dirty fluid manifold with a wellbore at an oil and/or gas wellsite.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
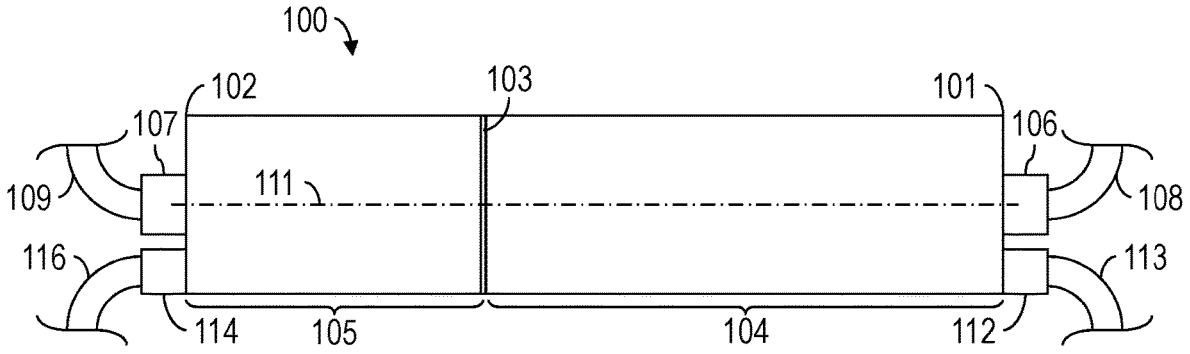
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. It should also be understood that the terms "first," "second," "third," etc., are arbitrarily assigned, are merely intended to differentiate between two or more parts, fluids, etc., and do not indicate a particular orientation or sequence.

The present disclosure introduces one or more aspects related to utilizing one or more pressure exchangers to divert a corrosive, abrasive, and/or solids-laden fluid (i.e., dirty fluid) away from high-pressure pumps, instead of pumping such fluid with the high-pressure pumps. A non-corrosive, non-abrasive, and solids-free fluid (i.e., clean fluid) may be pressurized by the high-pressure pumps, while the pressure exchangers, located downstream from the high-pressure pumps, transfer the pressure from the high-pressure clean fluid to a low-pressure dirty fluid. Such use of pressure exchangers may facilitate improved fluid control during well treatment operations and/or increased functional life of the high-pressure pumps and other wellsite equipment fluidly coupled between the high-pressure pumps and the pressure exchangers.

As used herein, a "fluid" is a substance that can flow and conform to the outline of its container when the substance is tested at a temperature of 71° F. (22° C.) and a pressure of one atmosphere (atm) (0.1 megapascals (MPa)). A fluid may be liquid, gas, or both. A fluid may be water based or oil based. A fluid may have just one phase or more than one distinct phase. A fluid may be a heterogeneous fluid having more than one distinct phase. Example heterogeneous fluids within the scope of the present disclosure include a solids-laden fluid or slurry (such as may comprise a continuous liquid phase and undissolved solid particles as a dispersed phase), an emulsion (such as may comprise a continuous liquid phase and at least one dispersed phase of immiscible liquid droplets), a foam (such as may comprise a continuous liquid phase and a dispersed gas phase), and mist (such as may comprise a continuous gas phase and a dispersed liquid droplet phase), among other examples also within the scope of the present disclosure. A heterogeneous fluid may comprise more than one dispersed phase. Moreover, one or more of the phases of a heterogeneous fluid may be or comprise a mixture having multiple components, such as fluids containing dissolved materials and/or undissolved solids.

Plunger pumps may be employed in high-pressure oilfield pumping applications, such as for hydraulic fracturing applications. Plunger pumps are often referred to as positive displacement pumps, intermittent duty pumps, triplex pumps, quintuplex pumps, or frac pumps. Multiple plunger pumps may be employed simultaneously in large-scale operations where tens of thousands of gallons of fluid are pumped into a wellbore. These pumps are linked to each other with a manifold, which is plumbed to collect the output of the multiple pumps and direct it to the wellbore.

As described above, some fluids may contain ingredients that are abrasive to the internal components of a pump. For example, a fracturing fluid generally contains proppant or other solid particulate material, which is insoluble in a base fluid. To create fractures, the fracturing fluid may be pumped at high-pressures ranging, for example, between about 5,000 PSI and about 15,000 PSI or more. The proppant may initiate the fractures and/or keep the fractures propped open. The propped fractures provide highly permeably flow paths for oil and gas to flow from the subterranean formation, thereby enhancing the production of a well. However, the abrasive fracturing fluid may accelerate wear of the internal components of the pumps. Consequently, repair, replacement, and maintenance expenses of the pumps can be quite high, and life expectancy can be low.

Example implementations of apparatus described herein relate generally to a fluid system for forming and pressurizing a solids-laden fluid (e.g., fracturing fluid) having predetermined concentrations of solid material for injection into a wellbore during well treatment operations. The fluid system may include a blending or mixing device for receiving and mixing a solids-free carrying fluid or gel and a solid material to form the solids-laden fluid. The fluid system may also include a fluid pressure exchanger for increasing pressure or otherwise energizing of the solids-laden fluid formed by the mixing device before being injected into the wellbore. The fluid pressure exchanger may be utilized to pressurize the solids-laden fluid by facilitating or permitting pressure from a pressurized solids-free fluid to be transferred to a low-pressure solids-laden fluid, among other uses. The fluid pressure exchanger may comprise one or more chambers into which the low-pressure solids-laden fluid and the pressurized solids-free fluid are conducted. The solids-free fluid may be conducted into the chamber at a higher pressure than the solids-laden fluid, and may thus be utilized to pressurize the solids-laden fluid. The pressurized solids-laden fluid is then conducted from the chamber to a wellhead for injection into the wellbore. By pumping just the solids-free fluid with the pumps and utilizing the pressure exchanger to increase the pressure of the solids-laden fluid, the useful life of the pumps may be increased. Example implementations of methods described herein relate generally to utilizing the fluid system to form and pressurize the solids-laden fluid for injection into the wellbore during well treatment operations. For clarity and ease of understanding, a corrosive, abrasive, and/or solids-laden fluid may be referred to hereinafter simply as a "dirty fluid" and a non-corrosive, non-abrasive, and solids-free fluid may be referred to hereinafter simply as a "clean fluid."

FIG. 1 is a schematic view of an example implementation of a chamber 100 of a fluid pressure exchanger for pressurizing a dirty fluid with a clean fluid according to one or more aspects of the present disclosure. The chamber 100 includes a first end 101 and a second end 102. The chamber 100 may include a border or boundary 103 between the dirty and clean fluids defining a first volume 104 and a second volume 105 within the chamber 100. The boundary 103 may be a membrane that is impermeable or semi-permeable to a fluid, such as a gas. The membrane may be an impermeable membrane in implementations in which the dirty and clean fluids are incompatible fluids, or when mixing of the dirty and clean fluids is to be substantially prevented, such as to recycle the clean fluid absent contamination by the dirty fluid. The boundary 103 may be a semi-permeable membrane in implementations permitting some mixing of the clean fluid with the dirty fluid, such as to foam the dirty fluid when the clean fluid comprises a gas.

The boundary 103 may be a floating piston or separator slidably disposed along the chamber 100. The floating piston may physically isolate the dirty and clean fluids and be movable via pressure differential between the dirty and clean fluids. The floating piston may be retained within the chamber 100 by walls or other features of the chamber 100. The density of the floating piston may be set between that of the clean and dirty fluids, such as may cause gravity to locate the floating piston at an interface of the dirty and clean fluids when the chamber 100 is oriented vertically.

The boundary 103 may also be a diffusion or mixing zone in which the dirty and clean fluids mix or otherwise interact during pressurizing operations. The boundary 103 may also not exist, such that the first and second volumes 104 and 105 form a continuous volume within the chamber 100. A first inlet valve 106 is operable to conduct the dirty fluid into the first volume 104 of the chamber 100, and a second inlet valve 107 is operable to conduct the clean fluid into the second volume 105 of the chamber 100.

Figure 2:
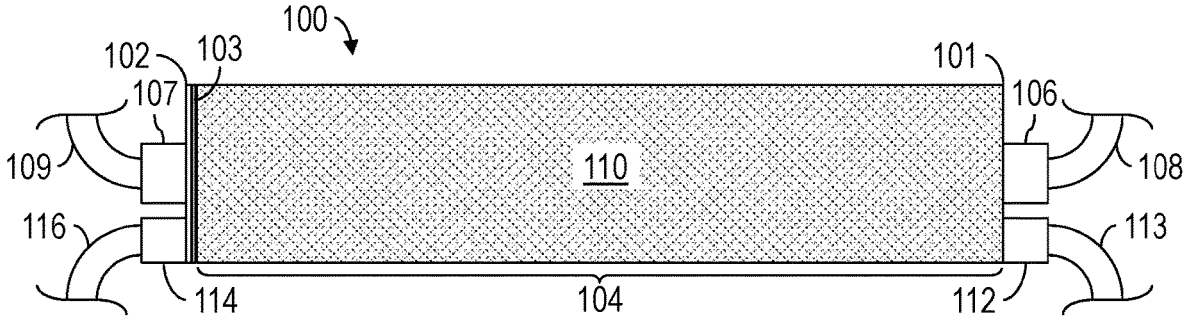
FIG. 2 is a schematic view of the apparatus shown in FIG. 1 in an operational stage according to one or more aspects of the present disclosure.

For example, FIG. 2 is a schematic view of the chamber 100 shown in FIG. 1 in an operational stage according to one or more aspects of the present disclosure, during which the dirty fluid 110 has been conducted into the chamber 100 through the first inlet valve 106 at the first end 101, such as via one or more fluid conduits 108. Consequently, the dirty fluid 110 may move the boundary 103 within the chamber 100 along a direction substantially parallel to the longitudinal axis 111 of the chamber 100, thereby increasing the first volume 104 and decreasing the second volume 105. The first inlet valve 106 may be closed after entry of the dirty fluid 110 into the chamber 100.

Figure 3:
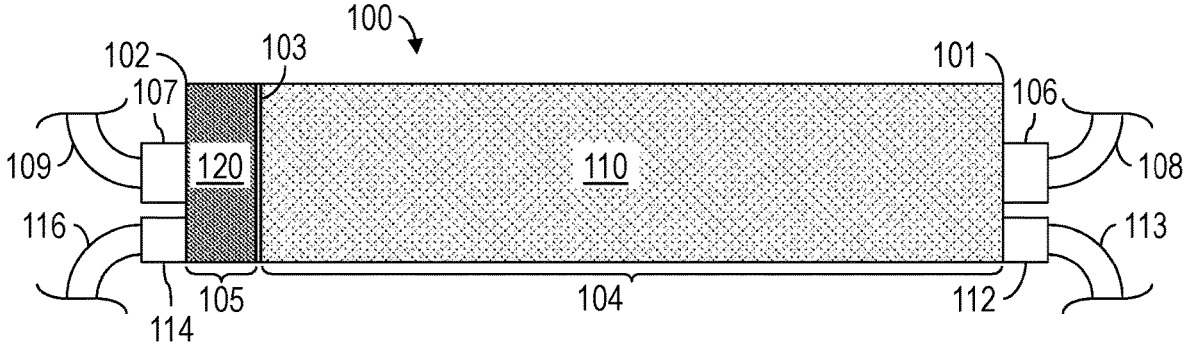
FIG. 3 is a schematic view of the apparatus shown in FIG. 2 in another operational stage according to one or more aspects of the present disclosure.

FIG. 3 is a schematic view of the chamber 100 shown in FIG. 2 in a subsequent operational stage according to one or more aspects of the present disclosure, during which a clean fluid 120 is being conducted into the chamber 100 through the second inlet valve 107 at the second end 102, such as via one or more fluid conduits 109. The clean fluid 120 may be conducted into the chamber 100 at a higher pressure compared to the pressure of the dirty fluid 110. Consequently, the higher-pressure clean fluid 120 may move the boundary 103 and the dirty fluid 110 within the chamber 100 back towards the first end 101, thereby reducing the volume of the first volume 104 and thereby pressurizing or otherwise energizing the dirty fluid 110. The clean fluid 120 may be a combustible or cryogenic gas that, upon combustion or heating, acts to pressurize the dirty fluid 110, whether instead of or in addition to the higher pressure of the clean fluid 120 acting to pressurize the dirty fluid 110. The boundary 103 and/or other components may include one or more burst discs to protect against overpressure from the clean fluid 120.

Figure 4:
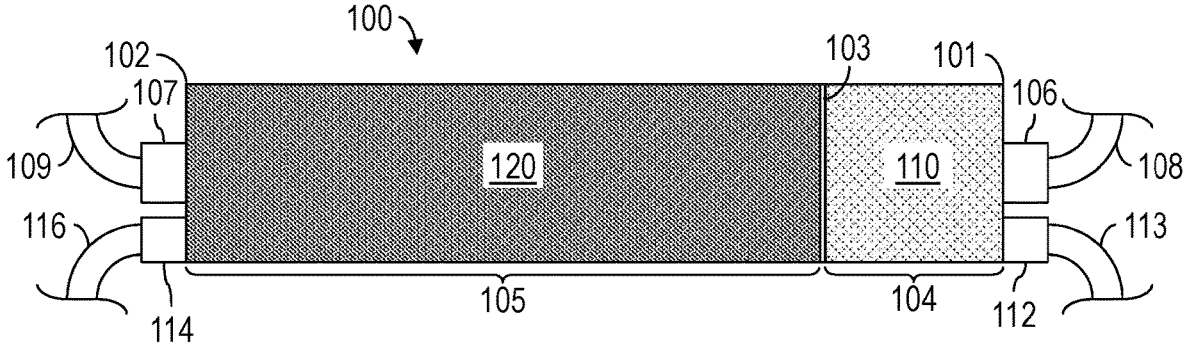
FIG. 4 is a schematic view of the apparatus shown in FIGS. 2 and 3 in another operational stage according to one or more aspects of the present disclosure.

As shown in FIG. 4, the boundary 103 may continue to reduce the first volume 104 as the pressurized dirty fluid 110 is conducted from the chamber 100 to a wellhead (not shown) at a higher pressure than when the dirty fluid 110 entered the chamber 100, such as via a first outlet valve 112 and one or more conduits 113. The second inlet valve 107 may then be closed, for example, in response to pressure sensed by a pressure transducer within the chamber 100 and/or along one or more of the conduits and/or inlet valves.

After the pressurized dirty fluid 110 is discharged from the chamber 100, the clean fluid 120 may be drained via an outlet valve 114 at the second end 102 of the chamber 100 and one or more conduits 116. The discharged clean fluid 120 may be stored as waste fluid or reused during subsequent iterations of the fluid pressurizing process. For example, additional quantities of the dirty and clean fluids 110, 120 may then be introduced into the chamber 100 to repeat the pressurizing process to achieve a substantially continuous supply of pressurized dirty fluid 110.

Figure 5:
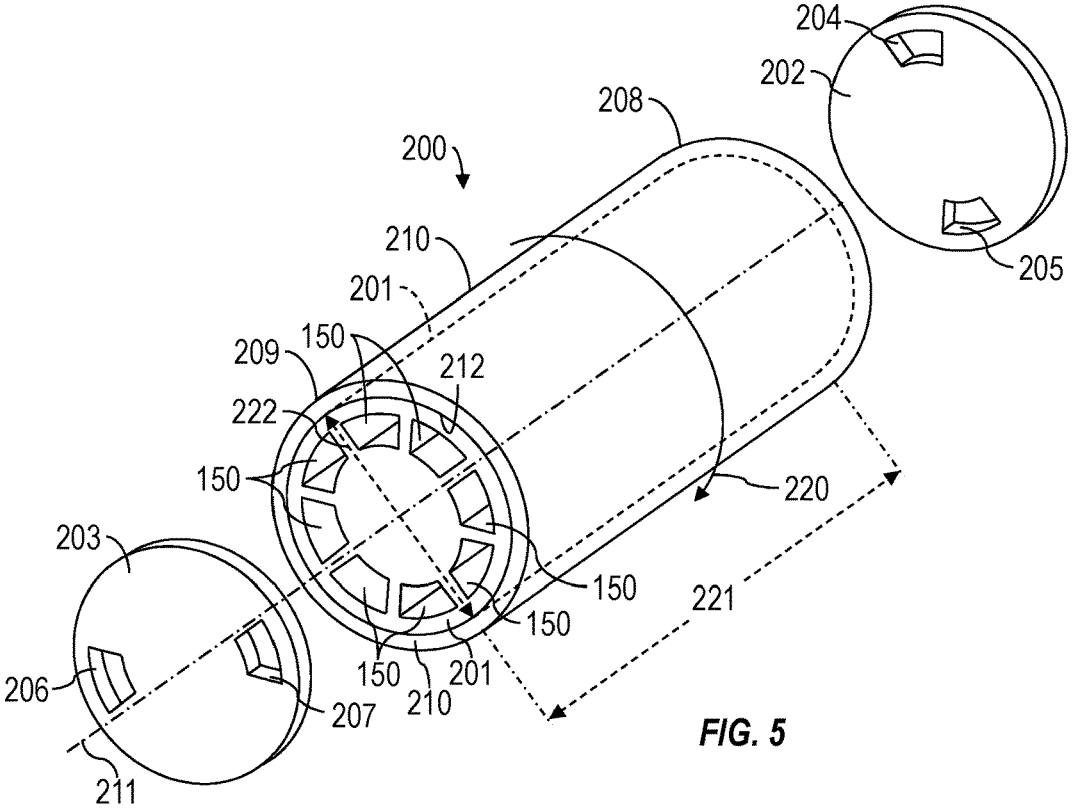
FIG. 5 is a partially exploded view of at least a portion of an example implementation of apparatus according to one or more aspects of the present disclosure.
Figure 6:
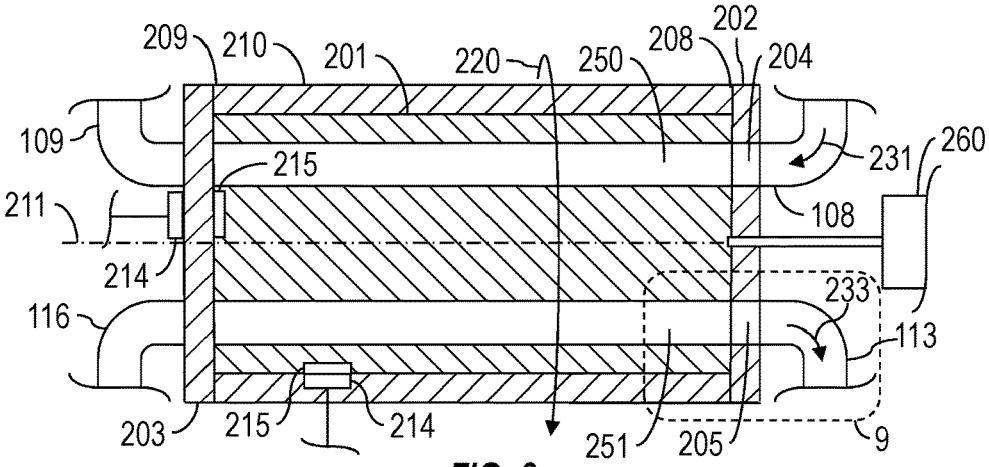
FIG. 6 is a sectional view of an example implementation of the apparatus shown in FIG. 5 according to one or more aspects of the present disclosure.
Figure 7:
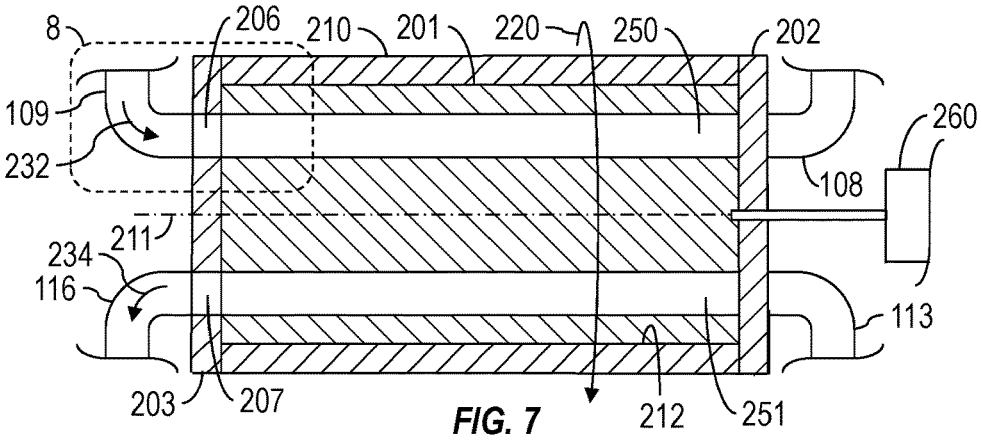
FIG. 7 is another sectional view of the apparatus shown in FIG. 6 in another operational stage.

A fluid pressure exchanger comprising the apparatus shown in FIGS. 1-4 and/or others within the scope of the present disclosure may also comprise more than one of the example chambers 100 described above. FIG. 5 is a schematic view of an example rotary pressure exchanger 200 comprising multiple chambers 100 shown in FIGS. 1-4 and designated in FIG. 5 by reference numeral 150. FIGS. 6 and 7 are sectional views of the pressure exchanger 200 shown in FIG. 5. The following description refers to FIGS. 5-7, collectively.

The pressure exchanger 200 may comprise a housing 210 having a bore 212 extending between opposing ends 208, 209 of the housing 210. An end cap 202 may cover the bore 212 at the end 208 of the housing 210, and another end cap 203 may cover the bore 212 at the opposing end 209 of the housing 210. The housing 210 and the end caps 202, 203 may be sealingly engaged and statically disposed with respect to each other. The housing 210 and the end caps 202, 203 may be distinct components or members, or the housing 210 and one or both of the end caps 202, 203 may be formed as a single, integral, or continuous component or member. A rotor 201 may be slidably disposed within the bore 212 of the housing 210 and between the opposing end caps 202, 203 in a manner permitting relative rotation of the rotor 201 with respect to the housing 210 and end caps 202, 203. The rotor 201 may have a plurality of bores or chambers 150 extending through the rotor 201 and circumferentially spaced around an axis of rotation 211 extending longitudinally through the rotor 201. The rotor 201 may be a discrete member, as depicted in FIGS. 5-7, or an assembly of discrete components, such as may permit replacing worn portions of the rotor 201 and/or utilizing different materials for different portions of the rotor 201 to account for expected or actual wear.

The rotation of the rotor 201 about the axis 211 is depicted in FIG. 5 by arrow 220. Rotation of the rotor 201 may be achieved by various means. For example, rotation may be induced by utilizing force of the fluids received by the pressure exchanger 200, such as in implementations in which the fluids may be directed into the chambers 150 at a diagonal angle with respect to the axis of rotation 211, thereby imparting a rotational force to the rotor 201 to rotate the rotor 201. Rotation may also be achieved by a longitudinal geometry or configuring of at least a portion of the chambers 150 extending through the rotor 201. For example, an inlet portion of the each chamber 150, or the entirety of each chamber 150, may extend in a helical manner with respect to the axis of rotation 211, such that the incoming stream of clean fluid imparts a rotational force to the rotor 201 to rotate the rotor 201.

Rotation may also be imparted via a motor 260 operably connected to the rotor 201. For example, the motor 260 may be an electrical or fluid powered motor connected with the rotor 201 via a shaft, a transmission, or another intermediate driving member, such as may extend through at least one of the end caps 202, 203 and/or the housing 210, to transfer torque to the rotor 201 to rotate the rotor 201. The motor 260 may also be connected with the rotor 201 via a magnetic shaft coupling, such as in implementations in which a driven magnet may be physically connected with the rotor 201 and a driving magnet may be located outside of the pressure exchanger 200 and magnetically connected with the driven magnet. Such implementations may permit the motor 260 to drive the rotor 201 without a shaft extending through the end caps 202, 203 and/or housing 210.

Rotation may also be imparted into the rotor 201 via an electrical motor (not shown) disposed about and connected with the rotor 201. For example, the electrical motor may comprise an electrical stator disposed about or included as part of the housing 210 and an electrical rotor connected about or included as part of the rotor 201. The electrical stator may comprise field coils or windings that generate a magnetic field when powered by electric current from a source of electric power. The electrical rotor may comprise windings or permanent magnets fixedly disposed about or included as part of the rotor 201. The electrical stator may surround the electrical rotor in a manner permitting rotation of the rotor 201 and electrical rotor within the housing 210 and electrical stator during operation of the electrical motor. The electrical motors utilized within the scope of the present disclosure may include, for example, synchronous and asynchronous electric motors.

The pressure exchanger 200 may also comprise means for sensing or otherwise determining the rotational speed of the rotor 201. For example, the rotor speed sensing means may comprise one or more sensors 214 associated the rotor 201 and operable to convert position or presence of a rotating or otherwise moving portion of the rotor 201, a feature of the rotor 201, or a marker 215 disposed in association with the rotor 201, into an electrical signal or information related to or indicative of the position and/or speed of the rotor 201. Each sensor 214 may be disposed adjacent the rotor 201 or otherwise disposed in association with the rotor 201 in a manner permitting sensing of the rotor or the marker 215 during pressurizing operations.

Each sensor 214 may sense one or more magnets on the rotor 201, one or more features on the rotor 201 that can be optically detected, conductive portions or members on the rotor 201 that can be sensed with an electromagnetic sensor, and/or facets or features on the rotor 201 that can be detected with an ultrasonic sensor, among other examples. Each sensor 214 may be or comprise a linear encoder, a capacitive sensor, an inductive sensor, a magnetic sensor, a Hall effect sensor, and/or a reed switch, among other examples. The speed sensing means may also include an intentionally imbalanced rotor 201 whose vibrations may be detected with an accelerometer and utilized to determine the rotational speed of the rotor 201.

The sensors 214 may extend through the housing 210, the end caps 202, 203, or another pressure barrier fluidly isolating the internal portion of the pressure exchanger 201 in a manner permitting the detection of the presence of the rotor 201 or marker 215 at a selected or predetermined position. The sensor 214 and/or an electrical conductor connected with the sensor 214 may be sealed against the pressure barrier, such as to prevent or minimize fluid leakage. However, a non-magnetic housing 210 and/or end caps 202, 203 may be utilized, such as may permit a magnetic field to pass therethrough and, thus, permit the sensors 214 to be disposed on the outside of the housing 210 and/or end caps 202, 203. The sensor 214 may also be an ultrasonic transducer operable to send a pressure wave through the housing 210 and into the rotor 201, such as in implementations in which the housing 210 is a steel housing and the rotor 201 is a ceramic stator. The pressure wave may be reflected from varying markers or portions of the rotor 201 and sensed by the ultrasonic transducer to determine the rotational speed of the rotor 201.

The end caps 202, 203 may functionally replace the valves 106, 107, 112, and 114 depicted in FIGS. 1-4. For example, the first end cap 202 may be substantially disc-shaped, or may comprise a substantially disc-shaped portion, through which an inlet 204 and an outlet 205 extend. The inlet 204 may act as the first inlet valve 106 shown in FIGS. 1-4, and the outlet 205 may act as the first outlet valve 112 shown in FIGS. 1-4. Similarly, the second end cap 203 may be substantially disc-shaped, or may comprise a substantially disc-shaped portion, through which an inlet 206 and an outlet 207 extend. The inlet 206 may act as the second inlet valve 107 shown in FIGS. 1-4, and the outlet 207 may act as the second outlet valve 114 shown in FIGS. 1-4. The fluid inlets and outlets 204-207 may have a variety of dimensions and shapes. For example, as in the example implementation depicted in FIG. 5, the inlets and outlets 204-207 may have dimensions and shapes substantially corresponding to the cross-sectional dimensions and shapes of the openings of each chamber 150 at the opposing ends of the rotor 201. However, other implementations are also within the scope of the present disclosure, provided that the chambers 150 may each be sealed against the end caps 202, 203 in a manner preventing or minimizing fluid leaks. For example the surfaces of the end caps 202, 203 that mate with the corresponding ends of the rotor 201 may comprise face seals and/or other sealing means.

In the example implementation depicted in FIG. 5, the rotor 201 comprises eight chambers 150. However, other implementations within the scope of the present disclosure may comprise as few as two chambers 150, or as many as several dozen. The rotational speed of the rotor 201 may also vary and may be timed as per the velocity of the boundary 103 between the dirty and clean fluids and the length 221 of the chambers 150 so that the timing of the inlets and outlets 204-207 are adjusted in order to facilitate proper functioning as described herein. The rotational speed of the rotor 201 may be based on the intended flow rate of the pressurized dirty fluid exiting the chambers 150 collectively, the amount of pressure differential between the dirty and clean fluids, and/or the dimensions of the chambers 150. For example, larger dimensions of the chambers 150 and greater rotational speed of the rotor 201 relative to the end caps 202, 203 and housing 210 will increase the discharge volume of the pressurized dirty fluid.

The size and number of instances of the fluid pressure exchanger 200 utilized at a wellsite in oil and gas operations may depend on the location of the fluid pressure exchanger 200 within the process flow stream at the wellsite. For example, some oil and gas operations at a wellsite may utilize multiple pumps (such as the pumps 306 shown in FIG. 11) that each receive low-pressure dirty fluid from a common manifold (such as the manifold 308 shown in FIG. 11) and then pressurize the dirty fluid for return to the manifold. For such operations, an instance of the fluid pressure exchanger 200 may be utilized between each pump and the manifold, and/or one or more instances of the fluid pressure exchanger 200 may replace one or more of the pumps. In such implementations, the rotor 201 may have a length 221 ranging between about 25 centimeters (cm) and about 150 cm and a diameter 222 ranging between about 10 cm and about 30 cm, the cross-sectional area (flow area) of each chamber 150 may range between about 5 $cm^2$ and about 20 $cm^2$, and/or the volume of each chamber 150 may range between about 75 cubic cm (cc) and about 2500 cc. However, other dimensions are also within the scope of the present disclosure. Some oil and gas operations at a wellsite may utilize multiple pumps that each receive low-pressure dirty fluid directly from a corresponding mixer (such as the mixer 304 shown in FIG. 11) or another source of dirty fluid and then pressurize the dirty fluid for injection directly into a well (such as the well 311 shown in FIG. 11). For such operations, an instance of the fluid pressure exchanger 200 may be utilized between each pump and the well, and/or one or more instances of the fluid pressure exchanger 200 may replace one or more of the pumps.

In some implementations, the pumps may each receive low-pressure clean fluid from the manifold (such as may be received at the manifold from a secondary fluid source) and then pressurize the clean fluid for return to the manifold. The high-pressure clean fluid may then be conducted from the manifold to one or more instances of the fluid pressure exchanger 200 to be utilized to pressurize low-pressure dirty fluid received from a gel maker, proppant blender, and/or other low-pressure mixing device, and the pressurized dirty fluid discharged from the fluid pressure exchangers 200 may be conducted towards the well. Examples of such operations include those shown in FIGS. 12-15, among other examples within the scope of the present disclosure. In such implementations, the length 221 of the rotor 201, the diameter 222 of the rotor 201, the flow area of each chamber 150, the volume of each chamber 150, and/or the number of chambers 150 may be much larger than as described above.

FIG. 6 is a sectional view of the pressure exchanger 200 shown in FIG. 5 during an operational stage in which two of the chambers are substantially aligned with the inlet and outlet 204, 205 of the first end cap 202, but not with the inlet and outlet 206, 207 of the second end cap 203. Thus, the inlet 204 fluidly connects one of the depicted chambers 150, designated by reference number 250 in FIG. 6, with the one or more conduits 108 supplying the non-pressurized dirty fluid, such that the non-pressurized dirty fluid may be conducted into the chamber 250. At the same time, the outlet 205 fluidly connects another of the depicted chambers 150, designated by reference number 251 in FIG. 6, with the one or more conduits 113 conducting previously pressurized dirty fluid out of the chamber 251, such as for conduction into a wellbore. As the rotor 201 rotates relative to the end caps 202, 203, the chambers 250, 251 will rotate out of alignment with the inlet and outlet 204, 205, thus preventing fluid communication between the chambers 250, 251 and the respective conduits 108, 113.

FIG. 7 is another view of the apparatus shown in FIG. 6 during another operational stage in which the chambers 250, 251 are substantially aligned with the inlet and outlet 206, 207 of the second end cap 203 but not with the inlet and outlet 204, 205 of the first end cap 202. Thus, the inlet 206 fluidly connects the chamber 250 with the one or more conduits 109 supplying the pressurizing or energizing clean fluid, such that the clean fluid may be conducted into the chamber 250. At the same time, the outlet 207 fluidly connects the other chamber 251 with the one or more conduits 116 conducting previously used pressurizing clean fluid out of the chamber 251, such as for recirculation. As the rotor 201 further rotates relative to the end caps 202, 203 and the housing 210, the chambers 250, 251 will rotate out of alignment with the inlet and outlet 206, 207, thus preventing fluid communication between the chambers 250, 251 and the respective conduits 109, 116.

The pressurizing process described above with respect to FIGS. 1-4 is achieved within each chamber 150, 250, 251 with each full rotation of the rotor 201 relative to the end caps 202, 203. For example, as the rotor 201 rotates relative to the end caps 202, 203 and the housing 210, the non-pressurized dirty fluid is conducted into the chamber 250 during the portion of the rotation in which the chamber 250 is in fluid communication with inlet 204 of the first end cap 202, as indicated in FIG. 6 by arrow 231. The rotation is continuous, such that the flow rate of the non-pressurized dirty fluid into the chamber 250 increases as the chamber 250 comes into alignment with the inlet 204 and then decreases as the chamber 250 rotates out of alignment with the inlet 204. Further rotation of the rotor 201 relative to the end caps 202, 203 permits the pressurizing clean fluid to be conducted into the chamber 250 during the portion of the rotation in which the chamber 250 is in fluid communication with the inlet 206 of the second end cap 203, as indicated in FIG. 7 by arrow 232. The influx of the pressurizing clean fluid into the chamber 250 pressurizes the dirty fluid due to the pressure differential between the dirty and clean fluids described above with respect to FIGS. 1-4.

Further rotation of the rotor 201 relative to the end caps 202, 203 and the housing 210 permits the pressurized dirty fluid to be conducted out of the chamber 250 during the portion of the rotation in which the chamber 250 is in fluid communication with the outlet 205 of the first end cap 202, as indicated in FIG. 6 by arrow 233. The discharged fluid may substantially comprise just the (pressurized) dirty fluid or a mixture of the dirty and clean fluids (also pressurized), depending on the timing of the rotor 201 and perhaps whether the chambers include the boundary 103 shown in FIGS. 1-4. Further rotation of the rotor 201 relative to the end caps 202, 203 permits the reduced-pressure clean fluid to be conducted out of the chamber 250 during the portion of the rotation in which the chamber 250 is in fluid communication with the outlet 207 of the second end cap 203, as indicated in FIG. 7 by arrow 234. The pressurizing process then repeats as the rotor 201 further rotates and the chamber 250 again comes into alignment with the inlet 204 of the first end cap 202.

Depending on the number and size of the chambers 150, the non-pressurized dirty fluid inlet 204 and the pressurizing clean fluid inlet 206 may be wholly or partially misaligned with each other about the central axis 211, such that the dirty fluid may be conducted into the chamber 150 to entirely or mostly fill the chamber 150 before the clean fluid is conducted into that chamber 150. The non-pressurized dirty fluid inlet 204 is completely closed to fluid flow from the conduit 108 before the pressurizing clean fluid inlet 206 begins opening. The pressurized dirty fluid outlet 205 and the reduced-pressure clean fluid outlet 207, however, may be partially open when the pressurizing clean fluid inlet 206 is permitting the clean fluid into the chamber 150. Similarly, the non-pressurized dirty fluid inlet 204 may be partially open when one or both of the pressurized dirty fluid outlet 205 and/or the reduced-pressure clean fluid outlet 207 is at least partially open.

The pressurized dirty fluid outlet 205 and the reduced-pressure clean fluid outlet 207 may be wholly or partially misaligned with each other about the central axis 211. For example, the pressurized dirty fluid (and perhaps a pressurized mixture of the dirty and clean fluids) may be substantially discharged from the chamber 150 via the pressurized dirty fluid outlet 205 before the remaining reduced-pressure clean fluid is permitted to exit through the reduced-pressure clean fluid outlet 207. As the rotor 201 continues to rotate relative to the end caps 202, 203 and the housing 210, the pressurized dirty fluid outlet 205 becomes closed to fluid flow, and the reduced-pressure clean fluid outlet 207 becomes open to discharge the remaining reduced-pressure clean fluid. Thus, the reduced-pressure clean fluid outlet 207 may be completely closed to fluid flow while the pressurized dirty fluid (or mixture of the dirty and clean fluids) is discharged from the chamber 150 to the wellhead. Complete closure of the reduced-pressure clean fluid outlet 207 may permit the pressurized fluid to maintain a higher-pressure flow to the wellhead.

The inlets and outlets 204-207 may also be configured to permit fluid flow into and out of more than one chamber 150 at a time. For example, the non-pressurized dirty fluid inlet 204 may be sized to simultaneously fill more than one chamber 150, the inlet and outlets 204-207 may be configured to permit non-pressurized dirty fluid to be conducted into a chamber 150 while the reduced-pressure clean fluid is simultaneously being discharged from that chamber 150. Depending on the size of the rotor 201 and the chambers 150, the fluid properties of the dirty and clean fluids, and the rotational speed of the rotor 201 relative to the end caps 202, 203, the pressurizing process within each chamber 150 may also be achieved in less than one rotation of the rotor 201 relative to the end caps 202, 203 and the housing 210, such as in implementations in which two, three, or more iterations of the pressurizing process is achieved within each chamber 150 during a single rotation of the rotor 201.

The flow of dirty fluid out of the pressure exchanger 200 via the fluid conduit 116 may be prevented or otherwise minimized by controlling the timing of the opening and closing of the fluid inlets 204, 206 and outlets 205, 207 of the pressure exchanger 200. For example, during the pressurizing operations, as the chambers 150 rotate, each chamber 150 is in turn aligned and, thus, fluidly connected with the low-pressure inlet 204 to receive the dirty fluid and the low-pressure outlet 207 to discharge the clean fluid. As the dirty fluid fills the chamber 150, the boundary 103 moves toward the low-pressure outlet 207 as the clean fluid is pushed out of the chamber 150. However, the rotation of the rotor 201 seals off the outlet 207 of the chamber 150 when or just before the boundary 103 reaches the outlet 207 to prevent or minimize the dirty fluid from entering into the fluid conduit 116. The chamber 150 then becomes aligned with the high-pressure inlet 206 and the high-pressure outlet 205 to permit the high-pressure clean fluid to enter the chamber 150 via the inlet 206 to push the dirty fluid from the chamber 150 via the outlet 205 at an increased pressure. As the clean fluid fills the chamber 150, the boundary 103 moves toward the high-pressure outlet 205 as the dirty fluid is pushed out of the chamber 150. However, the rotation of the rotor 201 seals off the outlet 205 of the chamber 150 when or just before the boundary 103 reaches the outlet 205 to prevent or minimize the clean fluid from entering into the fluid conduit 113. The clean fluid left in the chamber 150 may be pushed out through the fluid conduit 116 by the dirty fluid when the chamber 150 again becomes aligned with the low-pressure inlet 204 to receive the dirty fluid and the low-pressure outlet 207 to discharge the clean fluid. Such cycle may be continuously repeated to continuously receive and pressurize the stream of dirty fluid to form a substantially continuous or uninterrupted stream of dirty fluid.

Figure 8:
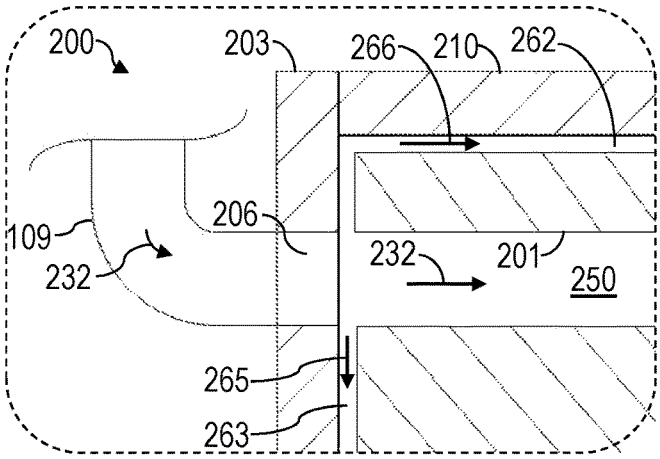
FIG. 8 is an enlarged view of the apparatus shown in FIG. 7 according to one or more aspects of the present disclosure.
Figure 9:
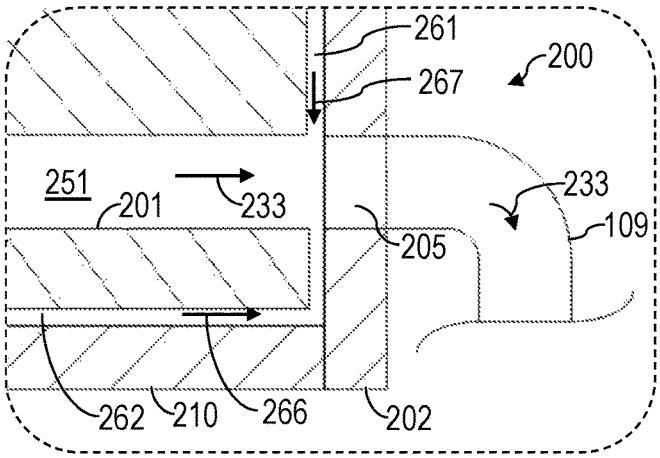
FIG. 9 is an enlarged view of the apparatus shown in FIG. 6 according to one or more aspects of the present disclosure.

FIGS. 8 and 9 are enlarged views of portions of the pressure exchanger 200 shown in FIGS. 7 and 6, respectively, according to one or more aspects of the present disclosure. The following description refers to FIGS. 6-9, collectively.

Small gaps or spaces 261, 262, 263 may be maintained between the rotor 201 and the housing 210 and end caps 202, 203 to permit rotation of the rotor 201 within the housing 210 and the end caps 202, 203. For clarity, the housing 210 and the end caps 202, 203 may be collectively referred to hereinafter as a "housing assembly." The spaces 261, 262, 263 may permit fluid flow between the rotor 201 and the housing assembly. For example, dirty fluid within the pressure exchanger 200 may flow through the space 261 along the end cap 202 from the high-pressure outlet 205 to the low-pressure fluid inlet 204, and through the spaces 261, 262, 263 along the housing 210 and end caps 202, 203 from the high-pressure outlet 205 to the clean fluid low-pressure outlet 207. Clean fluid within the pressure exchanger 200 may flow through the space 263 along the end cap 203 from the high-pressure inlet 206 to the low-pressure outlet 207, as indicated by arrow 265, and through the spaces 261, 262, 263 along the housing 210 and end caps 202, 203 from the high-pressure inlet 206 to the dirty fluid inlet and outlet 204, 205, as indicated by arrows 265, 266, 267.

The fluid flow through the spaces 261, 262, 263 within the pressure exchanger 200 may form a fluid film or layer operating as a hydraulic bearing or otherwise providing lubrication between the rotating rotor 201 and the static housing assembly, such as may prevent or reduce contact or friction between the rotor 201 and the housing assembly during pressurizing operations. The flow of fluids through the spaces 261, 262, 263 may be biased such that substantially just the clean fluid, and not the dirty fluid, flows through the spaces 261, 262, 263 during pressurizing operations, as indicated by arrows 265, 266, 267. Biasing the flow of clean fluid through the spaces 261, 262, 263 may also cause the clean/dirty fluid boundary 103 (shown in FIGS. 1-4) to maintain a net velocity directed toward the dirty fluid outlet 205. Accordingly, biasing the flow of clean fluid may result in substantially just the clean fluid being communicated through the spaces 261, 262, 263, such as to prevent or minimize friction or wear caused by the dirty fluid between the rotor 201 and the housing assembly. Biasing the flow of the clean fluid may also result in substantially just the clean fluid being discharged via the clean fluid outlet 207, such as to prevent or minimize contamination of the clean fluid discharged from the pressure exchanger 200.

Figure 10:
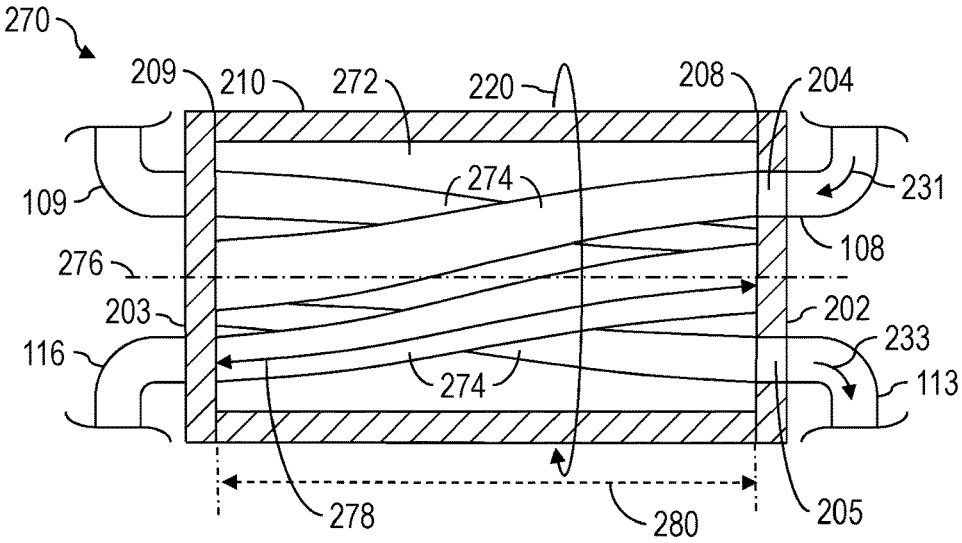
FIG. 10 is a sectional view of another example implementation of the apparatus shown in FIG. 5 according to one or more aspects of the present disclosure.

FIG. 10 is a sectional view of another example implementation of the pressure exchanger 200 shown in FIG. 5 according to one or more aspects of the present disclosure and designated in FIG. 10 by reference numeral 270. The pressure exchanger 270 is substantially similar in structure and operation to the pressure exchanger 200, including where indicated by like reference numbers, except as described below.

The pressure exchanger 270 may include a rotor 272 slidably disposed within the bore of the housing 210 and between the opposing end caps 202, 203 in a manner permitting relative rotation of the rotor 272 with respect to the housing 210 and end caps 202, 203. The rotor 272 may have multiple bores or chambers 274 extending through the rotor 272 between the opposing ends 208, 209 of the housing 210 and circumferentially spaced around an axis of rotation 276 extending longitudinally along the rotor 272. For the sake of clarity, cross-hatching of the rotor 272 is removed from FIG. 10, and just four chambers 274 are depicted, it being understood that other chambers 274 may also exist.

The chambers 274 extend through the rotor 272 in a helical manner about or otherwise with respect to the axis of rotation 276. As described above, such helical chamber implementations may be utilized to impart rotation to the rotor 272 instead of with a separate motor 260 or other rotary driving means. Such helical chamber implementations may also permit the length 278 of the chambers 274 to be greater than the axial length 280 of the rotor 272, which may permit the axial length 280 of the rotor 272 to be reduced. The increased length 278 of the chambers 274 may also permit the rotor 272 to be rotated at slower speeds than a rotor having chambers that extend substantially parallel with respect to an axis of rotation.

The pressure exchangers 200, 270 shown in FIGS. 5-10 and/or otherwise within the scope of the present disclosure may utilize various forms of the dirty and clean fluids described above. For example, the dirty fluid may be a high-density and/or high-viscosity solids-laden fluid comprising insoluble solid particulate material and/or other ingredients that may compromise the life or maintenance of pumps disposed downstream of the fluid pressure exchangers 200, 270, especially when such pumps are operated at higher pressures. Examples of the dirty fluid utilized in oil and gas operations may include treatment fluid, drilling fluid, spacer fluid, workover fluid, a cement composition, fracturing fluid, acidizing fluid, stimulation fluid, and/or combinations thereof, among other examples also within the scope of the present disclosure. The dirty fluid may be a foam, slurry, emulsion, or compressible gas. The viscosity of the dirty fluid may be sufficient to permit transport of solid additives or other solid particulate material (collectively referred to hereinafter as "solids") without appreciable settling or segregation. Chemicals, such as biopolymers (e.g. polysaccharides), synthetic polymers (e.g. polyacrylamide and its derivatives), crosslinkers, viscoelastic surfactants, oil gelling agents, low molecular weight organogelators, and phosphate esters, may also be included in the dirty fluid, such as to control viscosity of the dirty fluid.

The composition of the clean fluid may permit the clean fluid to be pumped at higher pressures with reduced adverse effects on the downstream pumps. For example, the clean fluid may be a solids-free fluid that does not include insoluble solid particulate material or other abrasive ingredients, or a fluid that includes low concentrations of insoluble solid particulate material or other abrasive ingredients. The clean fluid may be a liquid, such as water (including freshwater, brackish water, or brine), a gas (including a cryogenic gas), or combinations thereof. The clean fluid may also include substances, such as tracers, that can be transferred to the dirty fluid upon mixing within the chambers 150, 250, 274 or upon transmission through a semi-permeable implementation of the boundary 103. The viscosity of the clean fluid may also be increased, such as to minimize or reduce viscosity contrast between the dirty and clean fluids. Viscosity contrast may result in channeling of the lower viscosity fluid through the higher viscosity fluid. The clean fluid may be viscosified utilizing the same chemicals and/or techniques described above with respect to the dirty fluid.

The clean and/or dirty fluid may be chemically modified, such as via one or more fluid additives temporarily (or regularly) injected into the clean and/or dirty fluids to produce a reaction at the clean/dirty boundary 103 that acts to stabilize the boundary 103 (e.g., a membrane, mixing zone). For example, viscosity modification may be utilized to help form a substantially flat flow profile within the chambers 150, 250, 274. Also, one or repeated pulses of a cross linker applied to the clean fluid may be utilized to form cross linked gel pills in the chambers 150, 250, 274 to act as boundary stabilizers. Such stabilizers may be safely pumped into the well and replaced over time.

Furthermore, the clean and dirty fluids may be selected or formulated such that a reaction between the clean and dirty fluids creates a physical change at the clean/dirty boundary 103 that stabilizes the boundary 103. For example, the clean and dirty fluids may cross-link when interacting at the boundary 103 to produce a floating, viscous plug. The clean and dirty fluids may be formulated such that the plug or another product of such reaction may not damage downstream components when trimmed off and injected into the well by the action of the outlet 205 or another discharge valve.

The following are additional examples of the dirty and clean fluids that may be utilized during oil and gas operations. However, the following are merely examples, and are not considered to be limiting to the dirty and clean fluids and that may also be utilized within the scope of the present disclosure.

For fracturing operations, the dirty fluid may be a slurry with a continuous phase comprising water and a dispersed phase comprising proppant (including foamed slurries), including implementations in which the dispersed proppant includes two or more different size ranges and/or shapes, such as may optimize the amount of packing volume within the fractures. The dirty fluid may also be a cement composition (including foamed cements), or a compressible gas. For such fracturing implementations, the clean fluid may be a liquid comprising water, a foam comprising water and gas, a gas, a mist, or a cryogenic gas.

For cementing operations, including squeeze cementing, the dirty fluid may be a cement composition comprising water as a continuous phase and cement as a dispersed phase, or a foamed cement composition. For such cementing implementations, the clean fluid may be a liquid comprising water, a foam comprising water and gas, a gas, a mist, or a cryogenic gas.

For drilling, workover, acidizing, and other wellbore operations, the dirty fluid may be a homogenous solution comprising water, soluble salts, and other soluble additives, a slurry with a continuous phase comprising water and a dispersed phase comprising additives that are insoluble in the continuous phase, an emulsion or invert emulsion comprising water and a hydrocarbon liquid, or a foam of one or more of these examples. In such implementations, the clean fluid may be a liquid comprising water, a foam comprising water and gas, a gas, a mist, or a cryogenic gas.

In the above example implementations, and/or others within the scope of the present disclosure, the dirty fluid may include proppant; swellable or non-swellable fibers; a curable resin; a tackifying agent; a lost-circulation material; a suspending agent; a viscosifier; a filtration control agent; a shale stabilizer; a weighting agent; a pH buffer; an emulsifier; an emulsifier activator; a dispersion aid; a corrosion inhibitor; an emulsion thinner; an emulsion thickener; a gelling agent; a surfactant; a foaming agent; a gas; a breaker; a biocide; a chelating agent; a scale inhibitor; a gas hydrate inhibitor; a mutual solvent; an oxidizer; a reducer; a friction reducer; a clay stabilizing agent; an oxygen scavenger; cement; a strength retrogression inhibitor; a fluid loss additive; a cement set retarder; a cement set accelerator; a light-weight additive; a de-foaming agent; an elastomer; a mechanical property enhancing additive; a gas migration control additive; a thixotropic additive; and/or combinations thereof.

Figure 11:
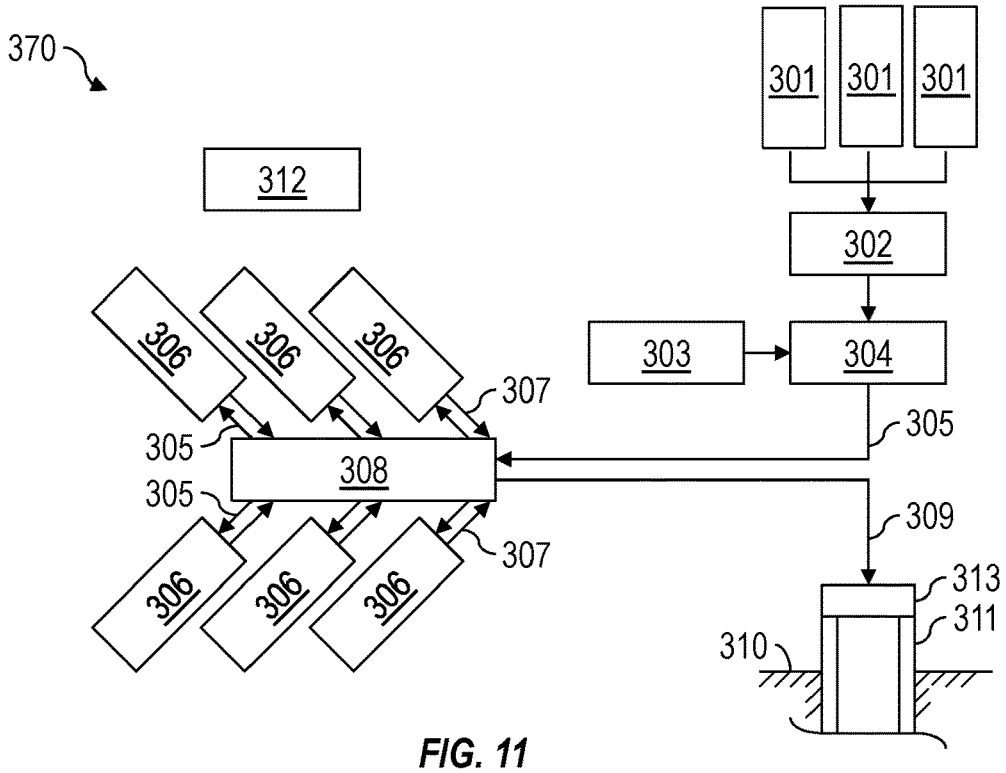
FIG. 11 is a schematic view of at least a portion of an example implementation of apparatus according to one or more aspects of the present disclosure.

FIG. 11 is a schematic view of an example wellsite system 370 that may be utilized for pumping a fluid from a wellsite surface 310 to a well 311 during a well treatment operation. Water from a plurality of water tanks 301 may be substantially continuously pumped to a gel maker 302, which mixes the water with a gelling agent to form a carrying fluid or gel, which may be a clean fluid. The gel may be substantially continuously pumped into a blending/mixing device, hereinafter referred to as a mixer 304. Solids, such as proppant and/or other solid additives stored in a solids container 303, may be intermittently or substantially continuously pumped into the mixer 304 to be mixed with the gel to form a substantially continuous stream or supply of treatment fluid, which may be a dirty fluid. The treatment fluid may be pumped from the mixer 304 to a plurality of plunger, frac, and/or other pumps 306 through a system of conduits 305 and a manifold 308. Each pump 306 pressurizes the treatment fluid, which is then returned to the manifold 308 through another system of conduits 307. The stream of treatment fluid is then directed to the well 311 via a wellhead 313 through a system of conduits 309. A control unit 312 may be operable to control various portions of such processing via wired and/or wireless communications (not shown).

Figure 12:
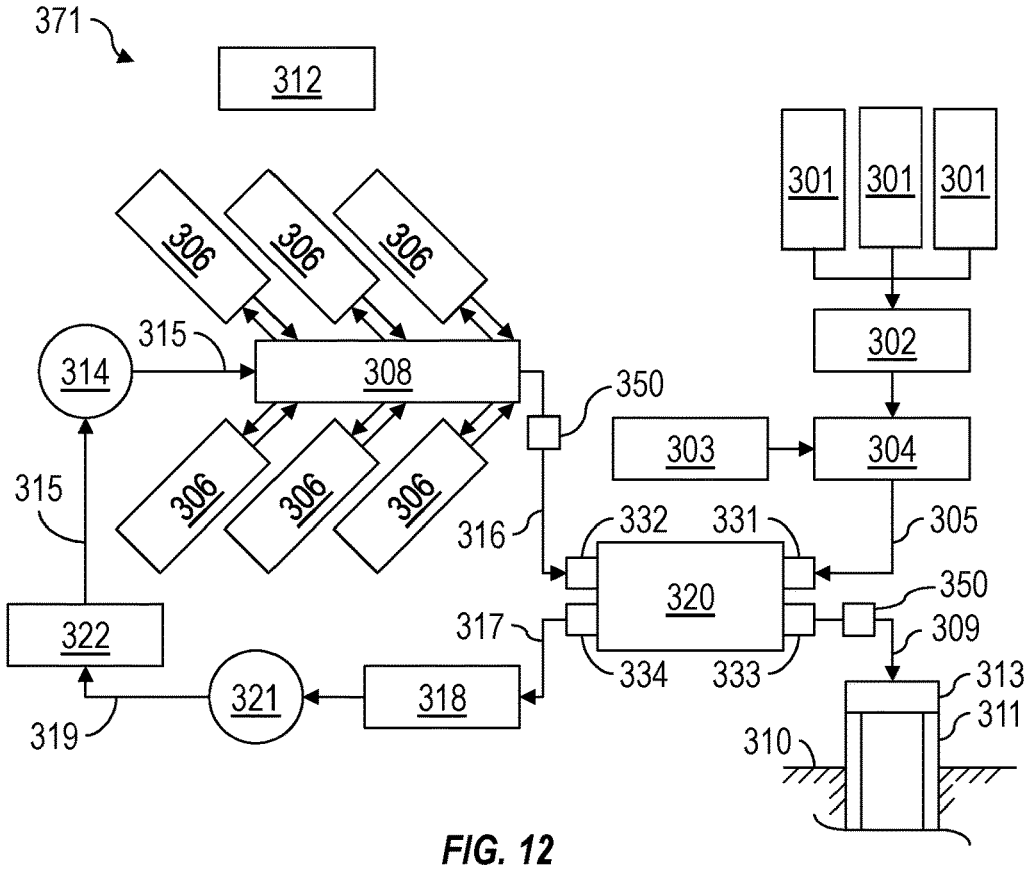
FIG. 12 is a schematic view of at least a portion of an example implementation of apparatus according to one or more aspects of the present disclosure.

FIG. 12 is a schematic view of an example implementation of another wellsite system 371 according to one or more aspects of the present disclosure. The wellsite system 371 comprises one or more similar features of the wellsite system 370 shown in FIG. 11, including where indicated by like reference numbers, except as described below.

The wellsite system 371 includes a fluid pressure exchanger 320, which may be utilized to eliminate or reduce pumping of dirty fluid through the pumps 306. The fluid pressure exchanger 320 may be, comprise, and/or otherwise have one or more aspects in common with the pressure exchangers described above and shown in one or more of FIGS. 1-10. The dirty fluid may be conducted from the mixer 304 to one or more chambers (not shown) of the fluid pressure exchanger 320 via the conduit system 305 and out of one or more chambers via a conduit system 309. The fluid pressure exchanger 320 comprises a low-pressure dirty fluid inlet 331, a high-pressure clean fluid inlet 332, a high-pressure fluid discharge or outlet 333, and a low-pressure fluid discharge or outlet 334. The chambers and the ports 331-334 of the pressure exchanger 320 may have one or more aspects in common with the chambers and the ports described above.

The pumps 306 may conduct the clean fluid to and from the manifold 308 and then to the high-pressure clean fluid inlet 332 of the fluid pressure exchanger 320, where the high-pressure clean fluid may be utilized to pressurize the dirty fluid received at the non-pressurized dirty fluid inlet 331 from the mixer 304. A centrifugal or other type of pump 314 may supply the clean fluid to the manifold 308 from a holding or frac tank 322 through a conduit system 315. An additional source of fluid to be pressurized by the manifold 308 may be flowback fluid from the well 311. The high-pressure clean fluid is conducted from the manifold 308 to one or more chambers of the fluid pressure exchanger 320 via a conduit system 316. The pressurized fluid discharged from the fluid pressure exchanger 320 is then conducted to the wellhead 313 of the well 311 via the conduit system 309. The reduced-pressure clean fluid remaining in the fluid pressure exchanger 320 (or chamber thereof) may then be conducted to a settling tank/pit 318 via a conduit system 317, where the fluid may be recycled back into the high-pressure stream via a centrifugal or other type of pump 321 and a conduit system 319, such as to the tank 322.

The wellsite system 371 may further comprise pressure sensors 350 operable to generate electric signals and/or other information indicative of pressure of the clean fluid upstream of the pressure exchanger 320 and/or pressure of the dirty fluid discharged from the pressure exchanger 320. For example, the pressure sensors 350 may be fluidly connected along the fluid conduits 309, 316. Additional pressure sensors may also be fluidly connected along the fluid conduits 305, 317 such as may be utilized to monitor pressure of the low-pressure clean and dirty fluids.

Some of the components, such as conduits, valves, and the manifold 308, may be configured to provide dampening to accommodate pressure pulsations. For example, liners that expand and contract may be employed to prevent problems associated with pumping against a closed valve due to intermittent pumping of the high-pressure fluid stream.

Figure 13:
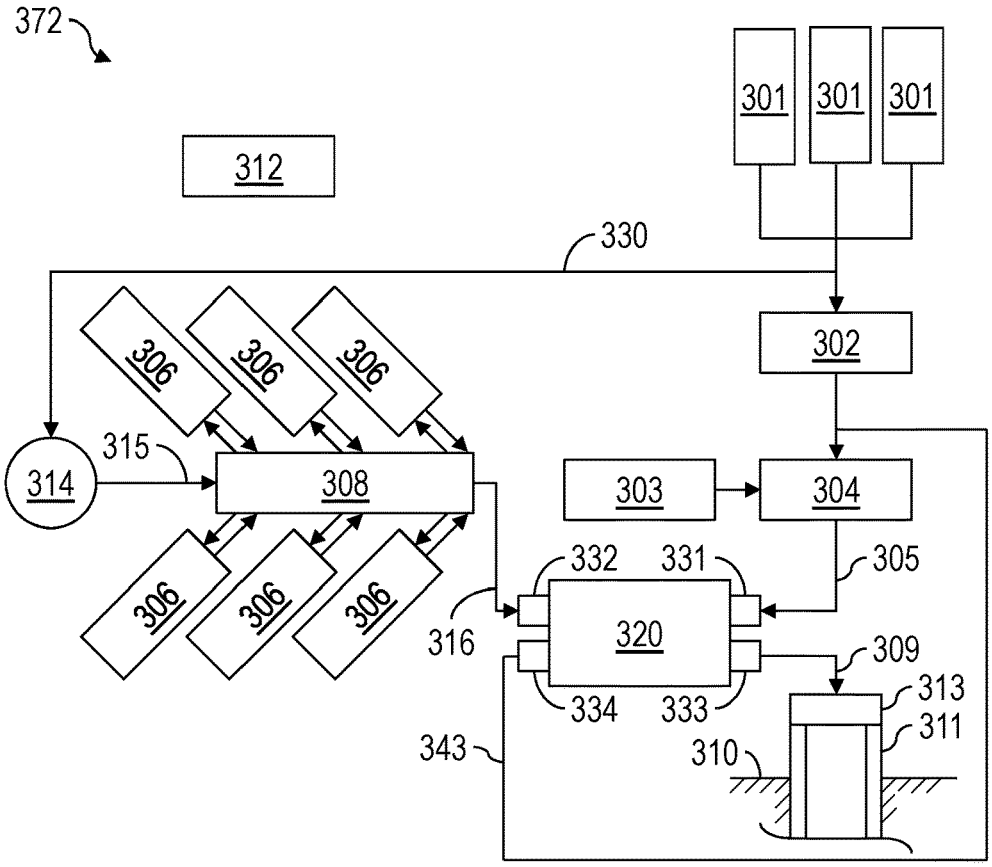
FIG. 13 is a schematic view of at least a portion of an example implementation of apparatus according to one or more aspects of the present disclosure.

FIG. 13 is a schematic view of an example implementation of another wellsite system 372 according to one or more aspects of the present disclosure. The wellsite system 372 comprises one or more similar features of the wellsite systems 370, 371 shown in FIGS. 11 and 12, respectively, including where indicated by like reference numbers, except as described below.

In the wellsite system 372, the clean fluid may be conducted to the manifold 308 via a conduit system 330, the pump 314, and the conduit system 315. That is, the fluid stream leaving the gel maker 302 may be split into a low-pressure side, for utilization by the mixer 304, and a high-pressure side, for pressurization by the manifold 308. Similarly, although not depicted in FIG. 13, the fluid stream entering the gel maker 302 may be split into the low-pressure side, for utilization by the gel maker 302, and the high-pressure side, for pressurization by the manifold 308. Thus, the clean fluid stream and the dirty fluid stream may have the same source, instead of utilizing the tank 322 or other separate clean fluid source.

FIG. 13 also depicts the option for the reduced-pressure fluid discharged from the fluid pressure exchanger 320 to be recycled back into the low-pressure clean fluid stream between the gel maker 302 and the mixer 304 via a conduit system 343. In such implementations, the flow rate of the proppant and/or other ingredients from the solids container 303 into the mixer 304 may be regulated based on the concentration of the proppant and/or other ingredients entering the low-pressure stream from the conduit system 343. The flow rate from the solids container 303 may be adjusted to decrease the concentration of proppant and/or other ingredients based on the concentrations in the fluid being recycled into the low-pressure stream. Similarly, although not depicted in FIG. 13, the reduced-pressure fluid discharged from the fluid pressure exchanger 320 may be recycled back into the low-pressure flow stream before the gel maker 302, or perhaps into the low-pressure flow stream between the mixer 304 and the fluid pressure exchanger 320.

Figure 14:
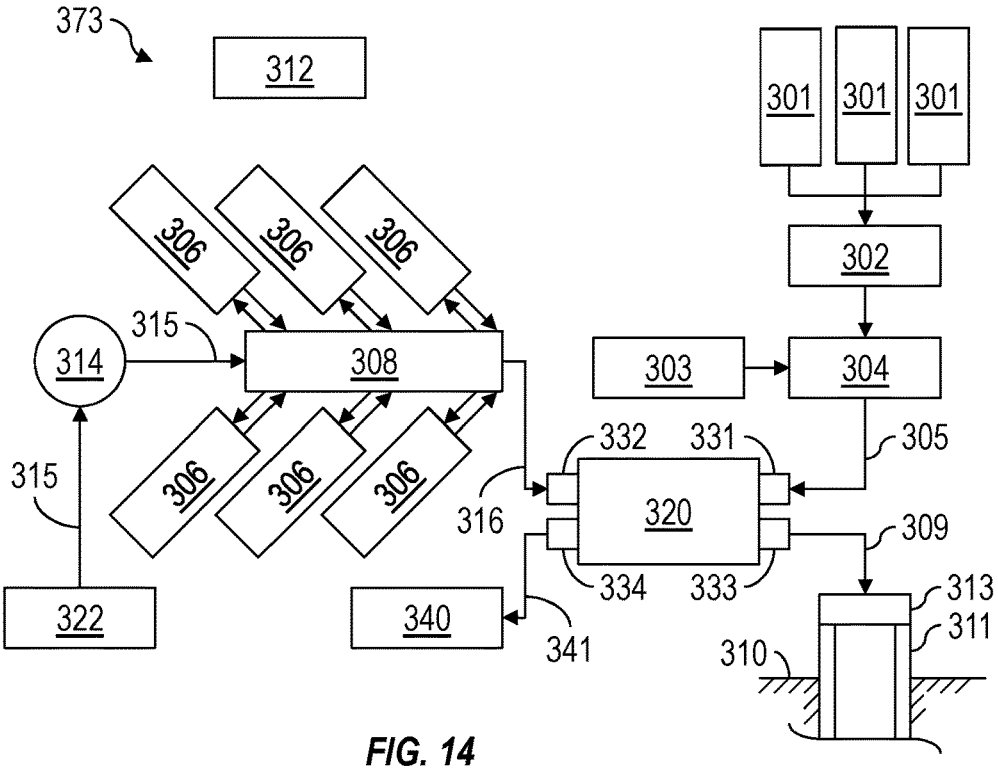
FIG. 14 is a schematic view of at least a portion of an example implementation of apparatus according to one or more aspects of the present disclosure.

FIG. 14 is a schematic view of an example implementation of another wellsite system 373 according to one or more aspects of the present disclosure. The wellsite system 373 comprises one or more similar features of the wellsite systems 370, 371, 372 shown in FIGS. 11, 12, and 13, respectively, including where indicated by like reference numbers, except as described below.

In the wellsite system 373, the source of the clean fluid is the tank 322, and the reduced-pressure fluid discharged from the fluid pressure exchanger 320 is not recycled back into the high-pressure stream, but is instead directed to a tank 340 via a conduit system 341. However, in a similar implementation, the reduced-pressure fluid discharged from the fluid pressure exchanger 320 is not recycled back into the high-pressure stream, as depicted in FIG. 13. In either implementation, utilizing the tank 322 or another source of the clean fluid separate from the discharge of the gel maker 302 and the fluid pressure exchanger 320 permits a single pass clean fluid system with very low probability of proppant entering the pumps 306.

Figure 15:
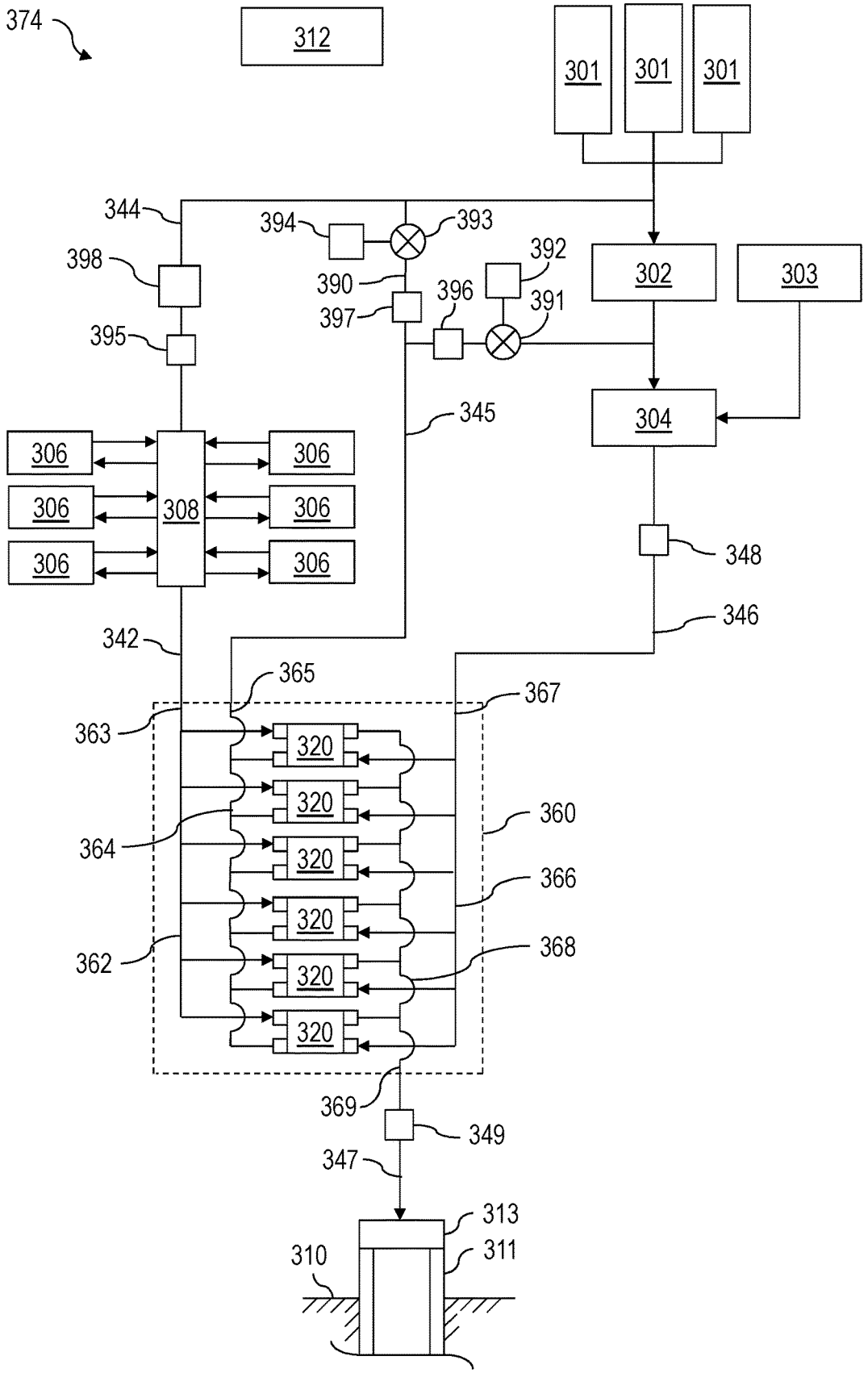
FIG. 15 is a schematic view of at least a portion of an example implementation of apparatus according to one or more aspects of the present disclosure.

FIG. 15 is a schematic view of an example implementation of another wellsite system 374 according to one or more aspects of the present disclosure. The wellsite system 374 comprises one or more similar features of the wellsite systems 370, 371, 372, 373 shown in FIGS. 11, 12, 13, and 14, respectively, including where indicated by like reference numbers, except as described below.

Unlike the wellsite systems 370-373, the wellsite system 374 comprises multiple pressure exchangers 320 integrated or otherwise combined as part of a pressure exchanger manifold assembly 360. The manifold assembly 360 may comprise several manifolds 362, 364, 366, 368 collectively configured to fluidly connect the pressure exchangers 320 with a source of high-pressure clean fluid (e.g., the fluid tanks 301, the pumps 306, and the manifold 308), a source of low-pressure dirty fluid (e.g., the mixer 304), and the wellbore 311.

The manifold assembly 360 may comprise a clean fluid distribution manifold 362 fluidly connected with the manifold 308 via a fluid conduit system 342 and configured to split up or otherwise distribute a high-pressure clean fluid received from the manifold 308 among the plurality of pressure exchangers 320. The manifold 308 may be fluidly connected with the water tanks 301 via a fluid conduit system 344. A booster pump 398, such as a centrifugal pump, may be fluidly connected along the fluid conduit system 344 to transfer the clean fluid from the tanks 301 to the manifold 308 via the conduit system 344. The clean fluid distribution manifold 362 may include an inlet port 363 fluidly connected with the fluid conduit system 342 and a plurality of outlet ports (not numbered) each fluidly connected with a clean fluid inlet 332 of a corresponding pressure exchanger 320. The manifold assembly 360 may further comprise a clean fluid collection manifold 364 (i.e., a depressurized clean fluid manifold) fluidly connected with an inlet of the mixer 304 via a fluid conduit system 345. The clean fluid collection manifold 364 may combine streams of depressurized (i.e., low-pressure) clean fluid discharged from the pressure exchangers 320 into a single stream for transfer to the mixer 304 and/or another destination. The clean fluid collection manifold 364 may have a plurality of inlet ports (not numbered) each fluidly connected with a clean fluid outlet 334 of a corresponding pressure exchanger 320. The clean fluid collection manifold 364 may also have an outlet port 365 fluidly connected with the fluid conduit system 345. The manifold assembly 360 may further comprise a dirty fluid distribution manifold 366 fluidly connected with an outlet of the mixer 304 via a fluid conduit system 346. The dirty fluid distribution manifold 366 may split a stream of low-pressure dirty fluid discharged from the mixer 304 into multiple streams and distribute the low-pressure dirty fluid among the pressure exchangers 320. The dirty fluid distribution manifold 366 may have an inlet port 367 fluidly connected with the fluid conduit system 346 and a plurality of outlet ports (not numbered) each fluidly connected with a dirty fluid inlet 331 of a corresponding pressure exchanger 320. The manifold assembly 360 may also comprise a dirty fluid collection manifold 368 (i.e., a pressurized dirty fluid manifold) fluidly connected with the wellbore 311 via a fluid conduit system 347. The dirty fluid collection manifold 368 may combine streams of a pressurized dirty fluid discharged from the pressure exchangers 320 into a single stream for transfer to the wellbore 311. The dirty fluid collection manifold 368 may have a plurality of inlet ports (not numbered) each fluidly connected with dirty fluid outlet 333 of a corresponding pressure exchanger 320 and an outlet port 369 fluidly connected with the fluid conduit system 347.

The fluid conduit systems 344, 345 may be fluidly connected via a fluid conduit system 390 extending between the fluid conduit systems 344, 345. The fluid conduit system 390 may permit a selected portion of the clean fluid discharged from the pressure exchangers 320 and flowing through the fluid conduit system 345 to be directed into the fluid conduit system 344 and fed into the pumps 306 via the manifold 308. The amount or flow rate of the clean fluid flowing through the fluid conduit system 345 into the mixer 304 may be adjusted via a flow control valve 391 fluidly connected along the fluid conduit system 345. The flow control valve 391 may be fluidly connected downstream from the fluid conduit system 390. The amount or the flow rate of the clean fluid discharged from the pressure exchangers 320 and directed into the pumps 306 via the fluid conduit system 390 may be adjusted via a flow control valve 393 fluidly connected along the fluid conduit system 390. The flow control valves 391, 393 may be or comprise flow rate control valves, such as needle valves, metering valves, butterfly valves, globe valves, or other valves operable to progressively or gradually open and close to control the flow rate of the clean fluid. Each fluid valve 391, 393 may be actuated remotely by a corresponding actuator 392, 394, operatively coupled with the valves 391, 393. The actuators may be or comprise electric actuators, such as solenoids or motors, or fluid actuators, such as pneumatic or hydraulic cylinders or rotary actuators. The fluid valves 391, 393 may also be actuated manually, such as by a lever (not shown).

The wellsite system 374 may further include one or more flow rate sensors 395, 396, 397, such as flow meters, operably connected along the fluid conduit systems 344, 345, 390, respectively. The flow rate sensors 395, 396, 397 may be operable to measure volumetric and/or mass flow rate of the clean fluid transferred via the respective fluid conduit systems 344, 345, 390. The flow rate sensors 395, 396, 397 may be electrical flow rate sensors operable to generate an electrical signal or information indicative of the measured flow rates.

The wellsite system 374 may perform density measurements along one or more fluid conduit systems to determine and control density of the dirty fluid being formed and/or injected into the wellbore 311. Accordingly, fluid analyzers 348, 349 may be disposed along the fluid conduit systems 346, 347 in a manner permitting monitoring of the flow rate and/or solids concentration of the fluid discharged from the mixer 304 and the manifold 360. Each fluid analyzer 348, 349 may comprise a density sensor operable to measure the solids concentration or the amount of particles in the fluid, which may be indicative of the amount of proppant or other solids in the fluids conducted by the conduit systems 346, 347. The density sensor may emit radiation that is absorbed by different particles in the fluid. Different absorption coefficients may exist for different particles, which may then be utilized to translate the signals or information generated by the density sensor to determine the density or solids concentration. Each fluid analyzer 348, 349 may also or instead comprise a flow rate sensor, such as a flow meter, operable to measure the volumetric and/or mass flow rate of the fluid.

Although the pressure exchangers 320 and the manifolds 362, 364, 366, 368 are shown as distinct members fluidly connected with each other, the pressure exchangers 320 may be or form at least a portion of one or more of the manifolds 362, 364, 366, 368. For example, the pressure exchangers 320 may be or comprise distinct units or sections of the manifolds 362, 364, 366, 368 detachably coupled together to form the manifolds 362, 364, 366, 368 and, thus, the manifold assembly 360.

Figure 16:
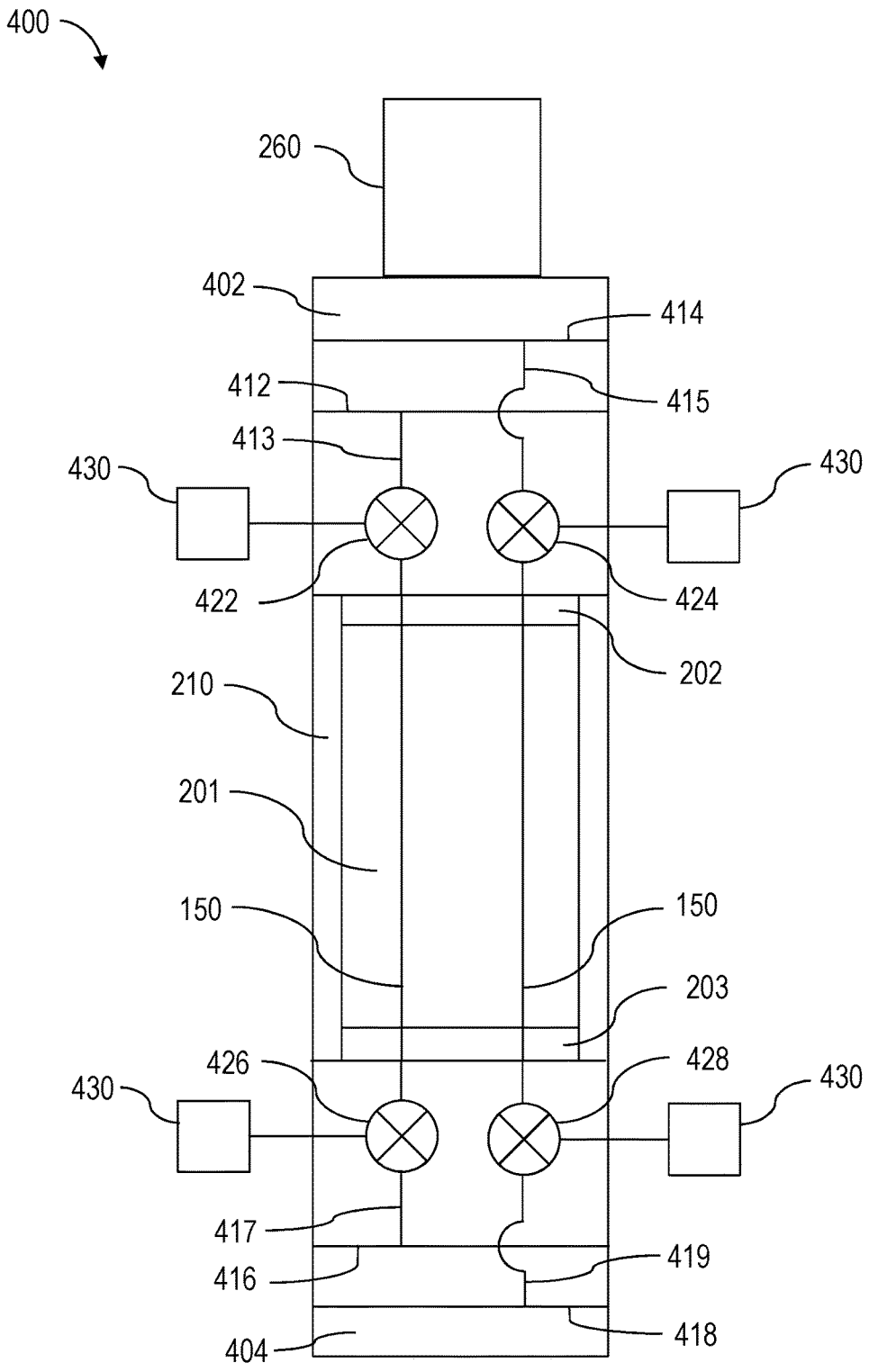
FIG. 16 is a schematic view of at least a portion of an example implementation of apparatus according to one or more aspects of the present disclosure.

FIG. 16 is a schematic view of an example implementation of a pressure exchanger 400 configured to be or form at least a portion of a pressure exchanger manifold assembly according to one or more aspects of the present disclosure. The pressure exchanger 400 comprises one or more similar features of the pressure exchangers described above, including where indicated by like reference numbers, except as described below.

The pressure exchanger 400 may comprise a housing 210 containing therein a rotor 201 having a plurality of chambers 150 circumferentially spaced and extending longitudinally through the rotor 201. The pressure exchanger 400 may further comprise heads 402, 404 disposed on opposing sides of the housing 210 and the rotor 201. End caps or other intermediate members 202, 203 may be disposed between the rotor 201 and each head 402, 404, however, the end caps or intermediate members 202, 203 may be omitted. Rotation may be imparted to the rotor 201 via a motor 260 mounted to the head 402 and operably connected with the rotor 201 via a shaft, a transmission, or another intermediate driving member (not shown).

The head 402 may comprise fluid passages 412, 414 (e.g., through bores) extending between opposing sidewalls of the head 402. The passage 412 may be fluidly connected with one or more of the chambers 150 of the rotor 201 via a fluid passage 413 extending between the passage 412 and an upper side of the rotor 201, such as may permit a high-pressure clean fluid to be introduced into the one or more chambers 150. The passage 414 may be fluidly connected with one or more of the chambers 150 (other than the chamber(s) 150 fluidly connected with the fluid passage 413) of the rotor 201 via a fluid passage 415 extending between the passage 414 and the upper side of the rotor 201, but fluidly isolated from the passage 413, such as may permit a depressurized clean fluid to be discharged from the one or more chambers 150. The head 402 may include fluid valves 422, 424 fluidly connected along the fluid passages 413, 415, respectively, to selectively permit and prevent fluid flow through the passages 413, 415.

The opposing head 404 may comprise fluid passages 416, 418 (e.g., through bores) extending between opposing sidewalls of the head 404. The passage 416 may be fluidly connected with the one or more chambers 150 that are fluidly connected with the fluid passage 413, via a fluid passage 417 extending between the passage 416 and a lower side of the rotor 201, such as may permit a pressurized (i.e., high-pressure) dirty fluid to be discharged from the one or more chambers 150. The passage 418 may be fluidly connected with the one or more chambers 150 that are fluidly connected with the fluid passage 415, via a fluid passage 419 extending between the passage 418 and the lower side of the rotor 201, such as may permit a low-pressure dirty fluid to be introduced into the one or more chambers 150. The head 404 may include fluid valves 426, 428 fluidly connected along the fluid passages 417, 419, respectively, to selectively permit and prevent fluid flow through the passages 417, 419. Each fluid valve 422, 424, 426, 428 may be actuated remotely by a corresponding actuator 430, operatively coupled with the valves 422, 424, 426, 428. The fluid valves 422, 424, 426, 428 may also be actuated manually, such as by a lever (not shown). A plurality of the pressure exchangers 400 may be fluidly connected together to form a pressure exchanger manifold assembly.

Figure 17:
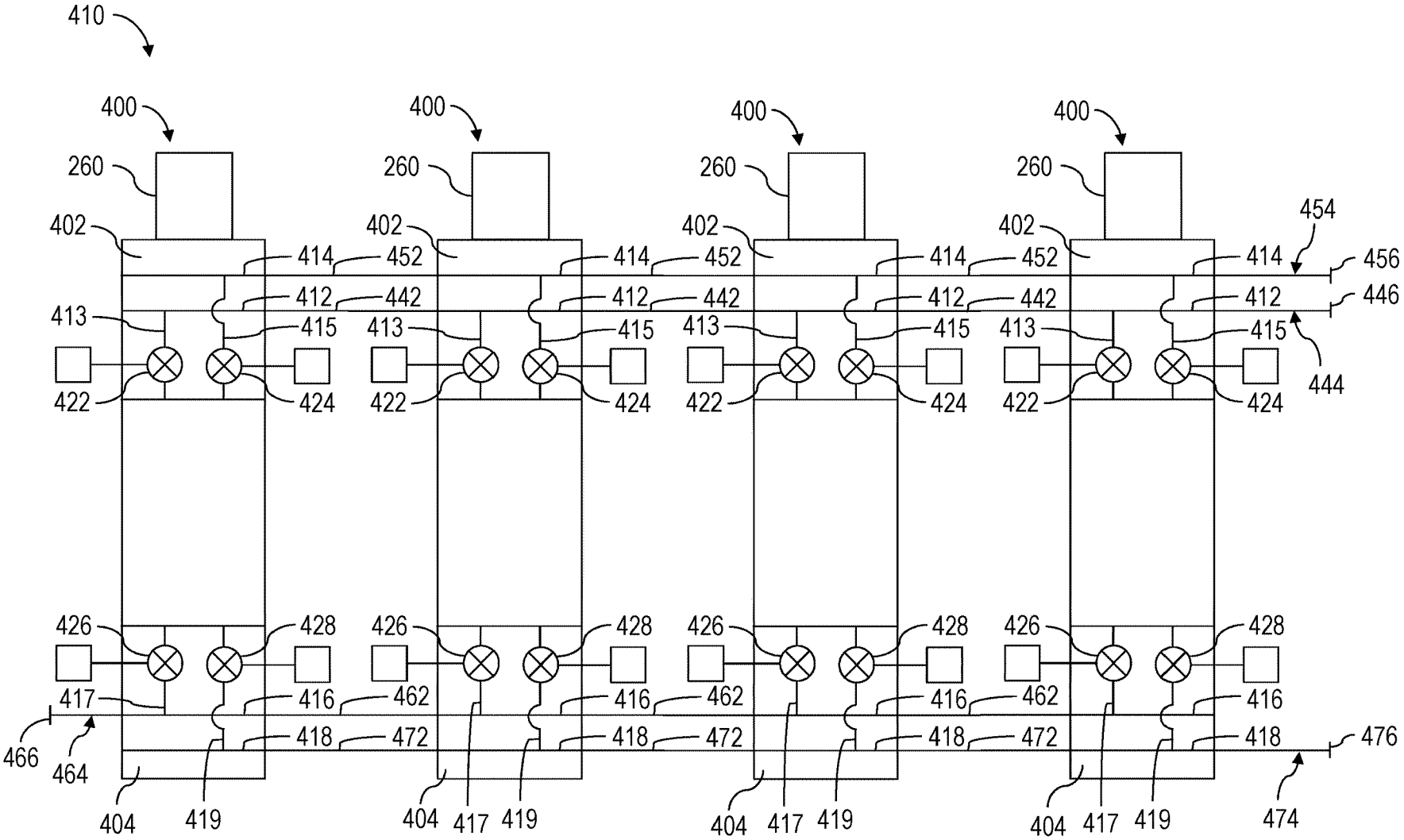
FIG. 17 is a schematic view of at least a portion of an example implementation of apparatus according to one or more aspects of the present disclosure.

FIG. 17 is a schematic view of an example implementation of a pressure exchanger manifold assembly 410 comprising a plurality of the pressure exchangers 400 shown in FIG. 16 according to one or more aspects of the present disclosure. The manifold assembly 410 comprises one or more similar features of the manifold assembly 360 described above, except as described below.

The passages 412 of the plurality of the pressure exchangers 400 may be fluidly connected in series via fluid conduits 442 to collectively form a clean fluid distribution manifold 444 (i.e., a high-pressure clean fluid manifold) configured to receive and split up or otherwise distribute the high-pressure clean fluid among the plurality of pressure exchangers 400. The fluid passages 413 of the plurality of the pressure exchangers 400 may be fluidly connected in parallel with the interconnected passages 412, such as may facilitate parallel distribution of the high-pressure clean fluid among the plurality of pressure exchangers 400. The clean fluid distribution manifold 444 may also include an inlet port 446, which may be fluidly connected with the conduit 342 or another conduit fluidly connected with a source of the high-pressure clean fluid, such as the manifold 308. As the clean fluid distribution manifold 444 conveys the high-pressure clean fluid, the passages 412 and the fluid conduits 442 are configured for high-pressure operations. The passages 414 of the plurality of the pressure exchangers 400 may be fluidly connected in series via fluid conduits 452 to collectively form a clean fluid collection manifold 454 (i.e., a depressurized clean fluid manifold) configured to combine streams of depressurized clean fluid discharged from the pressure exchangers 400 into a single stream. The fluid passages 415 of the plurality of the pressure exchangers 400 may be fluidly connected in parallel with the interconnected passages 414, such as may facilitate parallel collection of the depressurized clean fluid from the plurality of pressure exchangers 400. The clean fluid collection manifold 454 may include an outlet port 456, which may be fluidly connected with the fluid conduit 345 or another conduit fluidly connected with a destination of depressurized clean fluid, such as the mixer 304.

The passages 416 of the plurality of the pressure exchangers 400 may be fluidly connected in series via fluid conduits 462 to collectively form a dirty fluid collection manifold 464 (i.e., a pressurized dirty fluid manifold) configured to combine the streams of a pressurized dirty fluid discharged from the pressure exchangers 400 into a single stream for transfer to the wellbore 311. The fluid passages 417 of the plurality of the pressure exchangers 400 may be fluidly connected in parallel with the interconnected passages 416, such as may facilitate parallel collection of the pressurized dirty fluid from the plurality of pressure exchangers 400. The dirty fluid collection manifold 464 may include an outlet port 466, which may be fluidly connected with the fluid conduit 347 or another conduit fluidly connected with the wellbore 311. As the dirty fluid collection manifold 464 conveys the pressurized dirty fluid, the passages 416 and the fluid conduits 462 are configured for high-pressure operations. The passages 418 of the plurality of the pressure exchangers 400 may be fluidly connected in series via fluid conduits 472 to collectively form a dirty fluid distribution manifold 474 (i.e., a low-pressure dirty fluid manifold) configured to split a stream of a low-pressure dirty fluid discharged from a source of dirty fluid and distribute the dirty fluid among the plurality of pressure exchangers 400. The fluid passages 419 of the plurality of the pressure exchangers 400 may be fluidly connected in parallel with the interconnected passages 418, such as may facilitate parallel distribution of the low-pressure dirty fluid among the plurality of pressure exchangers 400. The dirty fluid distribution manifold 474 may include an inlet port 476, which may be fluidly connected with the fluid conduit 346 or another conduit fluidly connected with the source of the low-pressure dirty fluid, such as the mixer 304. Although the pressure exchanger manifold assembly 410 is shown comprising four pressure exchangers 400, a pressure exchanger manifold assembly within the scope of the present disclosure may comprise other quantities of pressure exchangers 400. For example, a pressure exchanger manifold assembly within the scope of the present disclosure may comprise between four and twenty pressure exchangers 400 or more.

Although FIGS. 16 and 17 show the pressure exchangers 400 comprising four fluid passages 412, 414, 416, 418 and, thus, configured to form the corresponding fluid manifolds 444, 454, 464, 474, pressure exchangers within the scope of the present disclosure may comprise other quantities of fluid passages (e.g., one, two, three) and, thus, configured to form other quantities of fluid manifolds. For example, pressure exchangers within the scope of the present disclosure may comprise the fluid passages 412, 416, but not 414, 418, and, thus, configured to form the clean fluid distribution manifold 444 and the dirty fluid collection manifold 464, but not the clean fluid collection manifold 454 nor the dirty fluid distribution manifold 474. In such implementations, an external clean fluid collection manifold and an external dirty fluid distribution manifold may be fluidly connected with the pressure exchangers.

Figure 18:
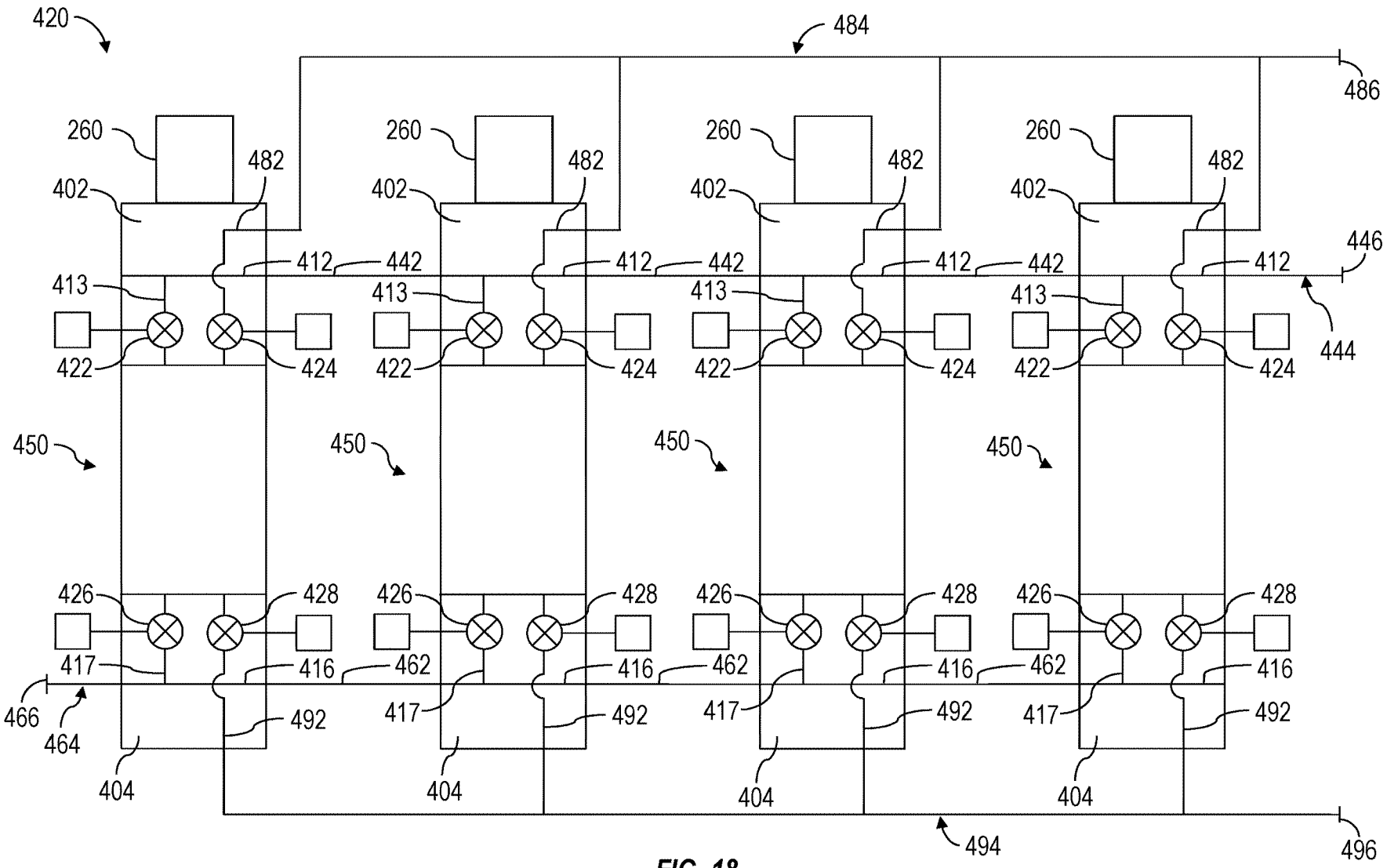
FIG. 18 is a schematic view of at least a portion of an example implementation of apparatus according to one or more aspects of the present disclosure.

FIG. 18 is a schematic view of an example implementation of a pressure exchanger manifold assembly 420 comprising a plurality of pressure exchangers 450 forming the clean fluid distribution manifold 444 and the dirty fluid collection manifold 464, but not the clean fluid collection manifold 454 nor the dirty fluid distribution manifold 474. The pressure exchanger manifold assembly 420 and the pressure exchangers 450 comprise one or more similar features of the pressure exchanger manifold assembly 410 and the pressure exchangers 450 described above, including where indicated by like reference numbers, except as described below.

Fluid passages 412 of the plurality of the pressure exchangers 450 may be fluidly connected in series via fluid conduits 442 and the fluid passages 413 may be fluidly connected in parallel with the interconnected passages 412 to collectively form a clean fluid distribution manifold 444.

However, instead of the fluid passages 414, 415, each head 402 may comprise a passage 482 extending between a sidewall of the head 402 and one or more of the chambers 150 (other than the chamber(s) 150 fluidly connected with the fluid passage 413) of the rotor 201, such as may permit the depressurized clean fluid to be discharged from the one or more chambers 150. The fluid passage 482 of each pressure exchanger 450 may be fluidly connected in parallel with a clean fluid collection manifold 484 (i.e., a depressurized clean fluid manifold) located externally to the pressure exchangers 450. The clean fluid collection manifold 484 may include an outlet port 486, which may be fluidly connected with the fluid conduit 345 or another conduit fluidly connected with a destination of depressurized clean fluid, such as the mixer 304.

The passages 416 of the plurality of the pressure exchangers 450 may be fluidly connected in series via fluid conduits 462 and the fluid passages 417 may be fluidly connected in parallel with the interconnected passages 416 to collectively form a dirty fluid collection manifold 464. However, instead of the fluid passages 418, 419, each head 404 may comprise a passage 492 extending between a sidewall of the head 404 and one or more of the chambers 150 (other than the chamber(s) 150 fluidly connected with the fluid passage 417) of the rotor 201, such as may permit the low-pressure dirty fluid to be introduced into the one or more chambers 150. The fluid passage 492 of each pressure exchanger 450 may be fluidly connected in parallel with a dirty fluid distribution manifold 494 located externally to the pressure exchangers 450. The dirty fluid distribution manifold 494 may include an inlet port 496, which may be fluidly connected with the fluid conduit 346 or another conduit fluidly connected with the source of the low-pressure dirty fluid, such as the mixer 304. Although the pressure exchanger manifold assembly 420 is shown comprising four pressure exchangers 450, a pressure exchanger manifold assembly within the scope of the present disclosure may comprise other quantities of pressure exchangers 450. For example, a pressure exchanger manifold assembly 420 within the scope of the present disclosure may comprise between four and twenty pressure exchangers 450 or more.

Figure 19:
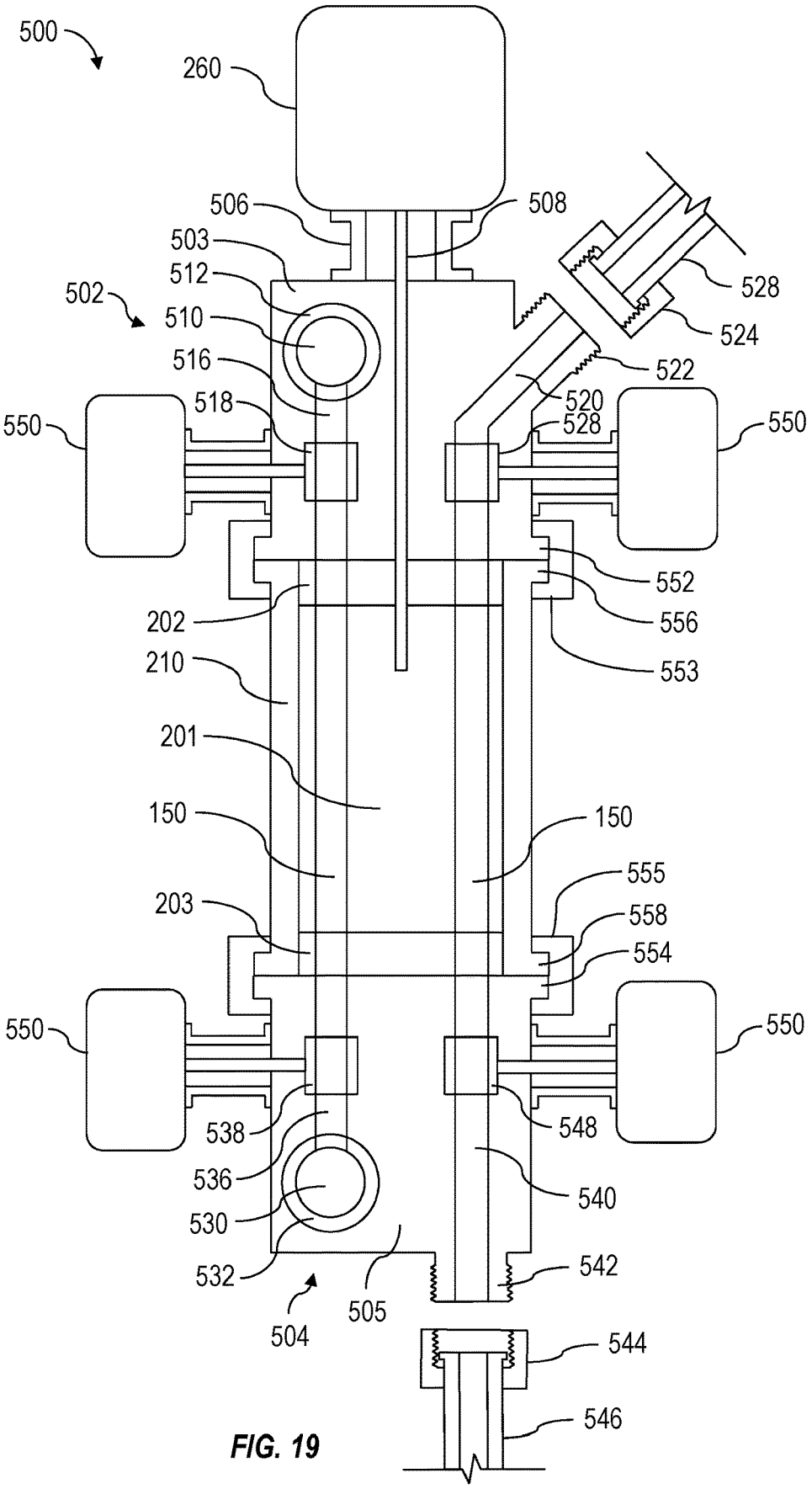
FIG. 19 is a sectional view of at least a portion of an example implementation of apparatus according to one or more aspects of the present disclosure.
Figure 20:
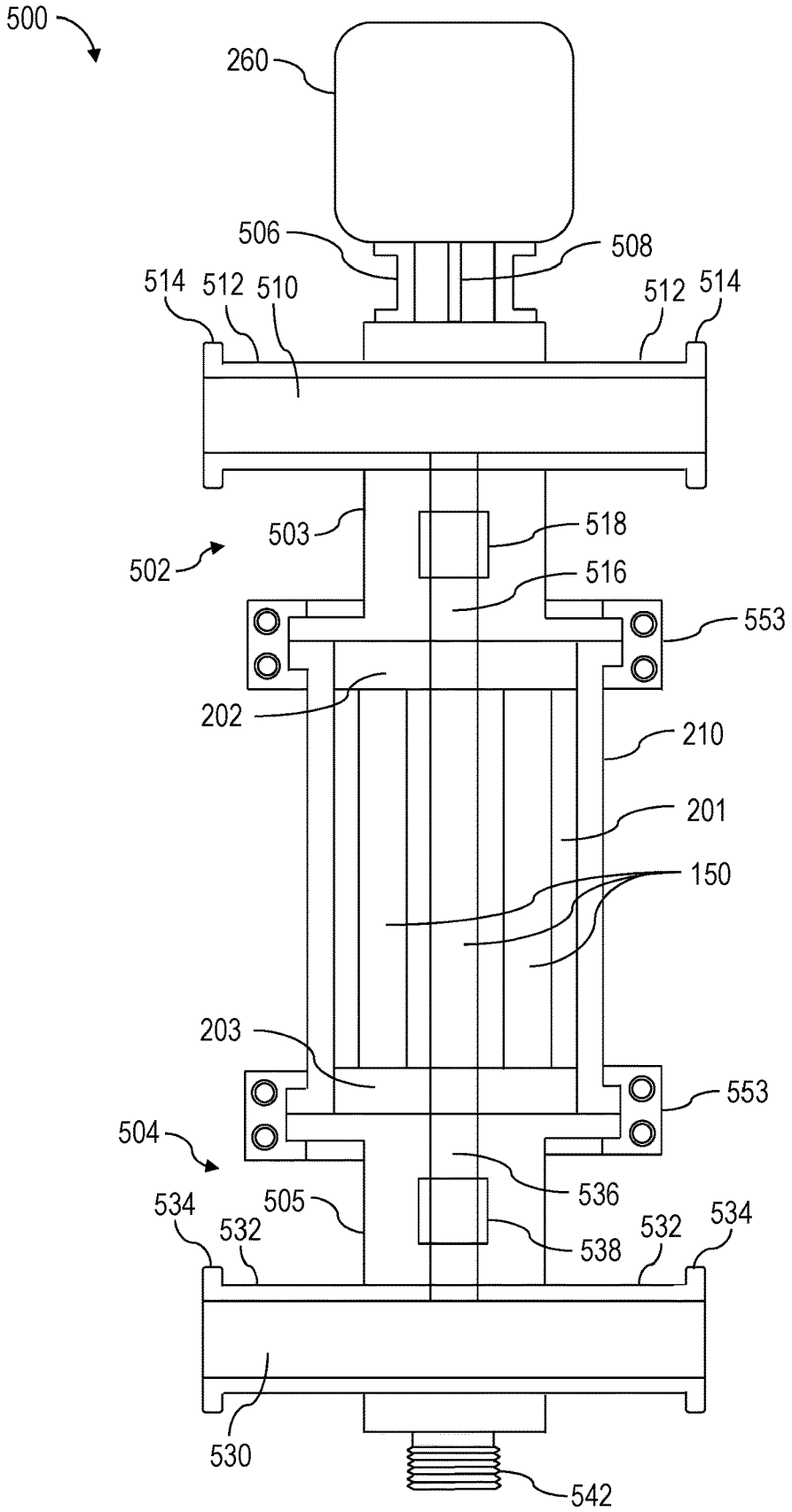
FIG. 20 is another sectional view of the apparatus shown in FIG. 19 according to one or more aspects of the present disclosure.

FIGS. 19 and 20 are schematic sectional views of an example implementation of a pressure exchanger 500 configured to be or form at least a portion of a clean fluid distribution manifold and a dirty fluid collection manifold of a manifold assembly according to one or more aspects of the present disclosure. The pressure exchanger 500 comprises one or more similar features of the pressure exchangers described above, including where indicated by like reference numbers, except as described below. The following description refers to FIGS. 19 and 20, collectively.

The pressure exchanger 500 comprises a housing 210 containing therein a rotatable rotor 201 having a plurality of chambers 150 circumferentially spaced and extending longitudinally through the rotor 201 between upper and lower faces of the rotor 201. The pressure exchanger 500 further comprises heads 502, 504 disposed on opposing sides of the housing 210 and the rotor 201. End caps or other intermediate members 202, 203 may be disposed between the rotor 201 and each head 502, 504, however, the end caps or intermediate members 202, 203 may be omitted. Rotation may be imparted to the rotor 201 via a motor 260 mounted to the head 502 via a mounting bracket 506, such as a bell housing, and operably connected with the rotor 201 via a shaft 508, a transmission, or another intermediate driving member. The heads 502, 504 and the housing 210 may be configured to be mechanically and sealingly coupled with each other. For example, the heads 502, 504 may comprise flanges 552, 554 configured to sealingly engage with corresponding flanges 556, 558 of the housing 210. The flanges 552, 556 and, thus, the head 502 and the housing 210, may be maintained together by a split clamp 553, while the flanges 554, 558 and, thus, the head 504 and the housing 210 may be maintained together by a split clamp 555. However, the heads 502, 504 and the housing 210 may be mechanically coupled via other means, such as a plurality of bolts (not shown) extending through each set of flanges 552, 556 and 554, 558.

The head 502 may comprise a fluid passage 510 (i.e., a through bore) extending between opposing external openings on opposing sides of the head 502. Portions of the head 502 defining or otherwise comprising the passage 510 may extend outwardly to extend the fluid passage 510 on opposing sides of the head 502. The extended portions of the head 502 may be or comprise rigid fluid conduits 512, such as tubular or pipe segments. The conduits 512 may be connected with and extend from a body portion 503 of the head 502 or the conduits 512 may be or comprise a continuous single-piece conduit portion extending through the body portion 503 on one or both sides of the body portion 503. Each conduit 512 may terminate with or comprise a coupling feature 514, such as may facilitate a mechanical and/or fluid connection with another fluid conduit or a corresponding conduit 512 of an adjacent pressure exchanger 500. The coupling features 514 may be or comprise fluid couplers or portions thereof, such as flanges, flares, lips, threads, threaded nuts, circumferential grooves, among other examples. The passage 510 may be fluidly connected with one or more of the chambers 150 of the rotor 201 via a fluid passage 516 extending between the passage 510 and an upper face of the rotor 201, such as may permit the high-pressure clean fluid to be introduced into the one or more chambers 150. The fluid passages 510, 518, the conduit 512, and the coupling features 514 may be or comprise a portion of the clean fluid distribution manifold, such as the clean fluid distribution manifold 444, and are thus configured for high-pressure operations. The passages 510, 516 may be or comprise a high-pressure clean fluid inlet of the pressure exchanger 500. A fluid valve 518 may be connected along the fluid passage 516 to selectively permit and prevent fluid flow through the passage 516.

The head 502 may further comprise a fluid passage 520 extending between an external opening on a sidewall of the body portion 503 of the head 502 and one or more of the chambers 150 (other than the chamber(s) 150 fluidly connected with the fluid passage 516) of the rotor 201 along the upper face of the rotor 201, such as may permit a depressurized clean fluid to be discharged from such one or more chambers 150. The head 502 may further comprise a coupling feature 522 at the end of the passage 520, such as may facilitate a fluid connection with a corresponding coupling feature 524 of a fluid conduit 528. The coupling features 522, 524 may be or comprise flanges, flares, lips, bosses, threads, threaded nuts, circumferential grooves, among other examples. The passage 520 may be or comprise a low-pressure clean fluid outlet of the pressure exchanger 500. A fluid valve 528 may be connected along the fluid passage 520 to selectively permit and prevent fluid flow through the passage 520. The fluid passage 520 may be fluidly connected with an external clean fluid collection manifold, such as the manifold 484. Thus, the fluid conduit 528 may be or comprise a portion of the clean fluid collection manifold.

The head 504 may comprise a fluid passage 530 (i.e., a through bores) extending between opposing external openings on opposing sides of the head 504. Portions of the head 502 defining or otherwise comprising the passage 530 may extend outwardly to extend the fluid passage 530 on opposing sides of the head 502. The extended portions of the head 502 may be or comprise rigid fluid conduits 532, such as tubular or pipe segments. The conduits 532 may be connected with and extend form a body portion 505 of the head 502 or the conduits 532 may be or comprise a continuous single-piece conduit portion extending through the body portion 505 on one or both sides of the body portion 505. Each conduit 532 may terminate with or comprise a coupling feature 534, such as may facilitate a mechanical and/or fluid connection with another fluid conduit or a corresponding conduit 532 of an adjacent pressure exchanger 500. The coupling features 534 may be or comprise fluid couplers or portions thereof, such as flanges, flares, lips, threads, threaded nuts, circumferential grooves, among other examples. The passage 530 may be fluidly connected with one or more of the chambers 150 of the rotor 201 via a fluid passage 536 extending between the passage 530 an a lower face of the rotor 201, such as may permit a pressurized dirty fluid to be discharged from the one or more chambers 150. The fluid passages 530, 536, the conduits 532, and the fluid couplings 534 may be or comprise a portion of a dirty fluid collection manifold, such as the dirty fluid collection manifold 464, and are thus configured for high-pressure operations. A fluid valve 538 may be connected along the fluid passage 536 to selectively permit and prevent fluid flow through the passage 536.

The head 504 may further comprise a fluid passage 540 extending between an external opening on a sidewall of the body portion 505 of the head 504 and one or more of the chambers 150 (other than the chamber(s) 150 fluidly connected with the fluid passage 536) of the rotor 201 along the lower face of the rotor 201, such as may permit the low-pressure dirty fluid to be introduced the such one or more chambers 150. The head 504 may further comprise a coupling feature 542 at the end of the passage 540, such as may facilitate a fluid connection with a corresponding coupling feature 544 of a fluid conduit 546. The coupling features 542, 544 may be or comprise flanges, flares, lips, bosses, threads, threaded nuts, circumferential grooves, among other examples. The passage 540 may be or comprise a low-pressure dirty fluid inlet of the pressure exchanger 500. A fluid valve 548 may be connected along the fluid passage 520 to selectively permit and prevent fluid flow through the passage 540. The fluid passage 540 may be fluidly connected with an external dirty fluid distribution manifold, such as the manifold 494. Thus, the fluid conduit 546 may be or comprise a portion of the dirty fluid distribution manifold.

The fluid valves 518, 528, 538, 548 may be or comprise fluid shut-off valves, such as ball valves, globe valves, butterfly valves, and/or other types of fluid valves, which may be selectively opened and closed to permit and prevent fluid flow through the respective fluid passages 516, 520, 536, 540. As the fluid passages 516, 536 are exposed to high fluid pressures, the fluid valves 518, 538 are configured for high-pressure applications. The fluid valves 518, 528, 538, 548 may be actuated remotely by corresponding actuators 550 operatively coupled with the valves 518, 528, 538, 548. The actuators 550 may be or comprise electric actuators, such as solenoids or motors, or fluid actuators, such as pneumatic or hydraulic cylinders or rotary actuators. The fluid valves 518, 528, 538, 548 may also be actuated manually, such as by a lever (not shown).

FIGS. 21-24 are sectional views of example connection means forming a portion of or utilized in conjunction with the pressure exchanger 500 shown in FIGS. 19 and 20 to detachably mechanical and/or fluidly connect a plurality of pressure exchangers 500 to form at least a portion of a pressure exchanger manifold assembly according to one or more aspects of the present disclosure. The connection means may be or comprise couplings for fluidly and/or mechanically connecting the conduits 512, 532 and, thus, the internal fluid passages 510, 530, of adjacent pressure exchangers 500 in series to collectively form a high-pressure clean fluid distribution manifold and a pressurized (i.e., high-pressure) dirty fluid collection manifold of a pressure exchanger manifold assembly.

Figure 21:
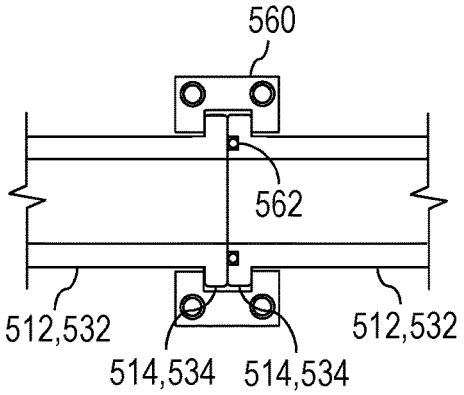
FIGS. 21-24 are sectional views of a portion of example implementations of the apparatus shown in FIGS. 19 and 20 according to one or more aspects of the present disclosure.

The connection means shown in FIG. 21 includes the coupling features 514, 534 implemented as corresponding flanges configured to sealingly engage to fluidly connect the conduits 512, 532 of adjacent pressure exchangers 500. The corresponding flanges may be maintained together by a split clamp 560 disposed around the flanges and locked together. A fluid seal 562 may be disposed on a face of one or more on the flanges to reduce or prevent fluid communication between the flanges.

Figure 22:
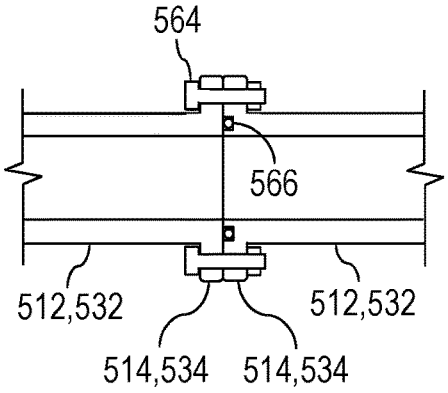

The connection means shown in FIG. 22 includes the coupling features 514, 534 implemented as corresponding flanges configured to sealingly engage to fluidly connect the conduits 512, 532 of adjacent pressure exchangers 500. The corresponding flanges may be maintained together by a plurality of bolts 564 extending though the flanges. A fluid seal 566 may be disposed on a face of one or more on the flanges to reduce or prevent fluid communication between the flanges.

Figure 23:
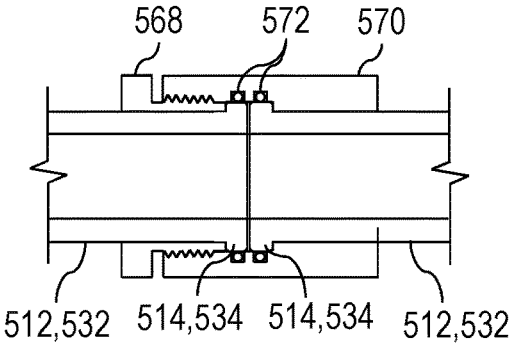

The connection means shown in FIG. 23 includes the coupling features 514, 534 implemented as lips extending circumferentially around the conduits 512, 532 of adjacent pressure exchangers 500. The connection means may further include corresponding threaded connectors 568, 570 slidably disposed about corresponding conduits 512, 532 of adjacent pressure exchangers 500. As the threaded connectors 568, 570 (e.g., a threaded sleeve and a threaded nut) are threadedly engaged, the connectors 568, 570 may contact outer shoulders of the lips to lock the adjacent conduits 512, 532 in position. Fluid seals 572 may be disposed about an inner surface of the connector 570, such that when the adjacent conduits 512, 532 are locked in position, the seals 572 may seal against the lips to reduce or prevent fluid communication between the lips and the connector 570.

Figure 24:
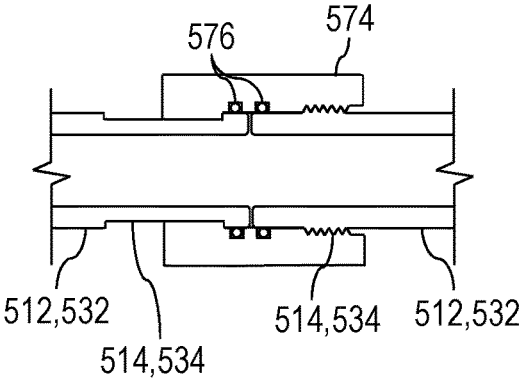

The connection means shown in FIG. 24 includes the coupling features 514, 534 implemented as a circumferential groove extending around one of adjacent conduits 512, 532 and threads extending around the other of the adjacent conduits 512, 532. The connection means may further include a threaded connector 574 (e.g., a threaded nut) slidably disposed within the groove of the conduit 512, 532. The threaded connector 574 may be slid along the groove toward the threads and rotated to engage the threads. As the threaded connector 574 threadedly engages the threads of the conduit 512, 532, the connector 574 may contact a shoulder of the groove to lock the adjacent conduits 512, 532 in position. Once the threaded connector 574 fully engages the threads, the adjacent conduits 512, 532 are locked in position. Fluid seals 576 may be disposed about an inner surface of the connector 574, such that when the conduits 512, 532 are locked in position, the seals 574 may seal against the conduits 512, 532 to reduce or prevent fluid communication between the conduits 512, 532 and the connector 574.

Figure 25:
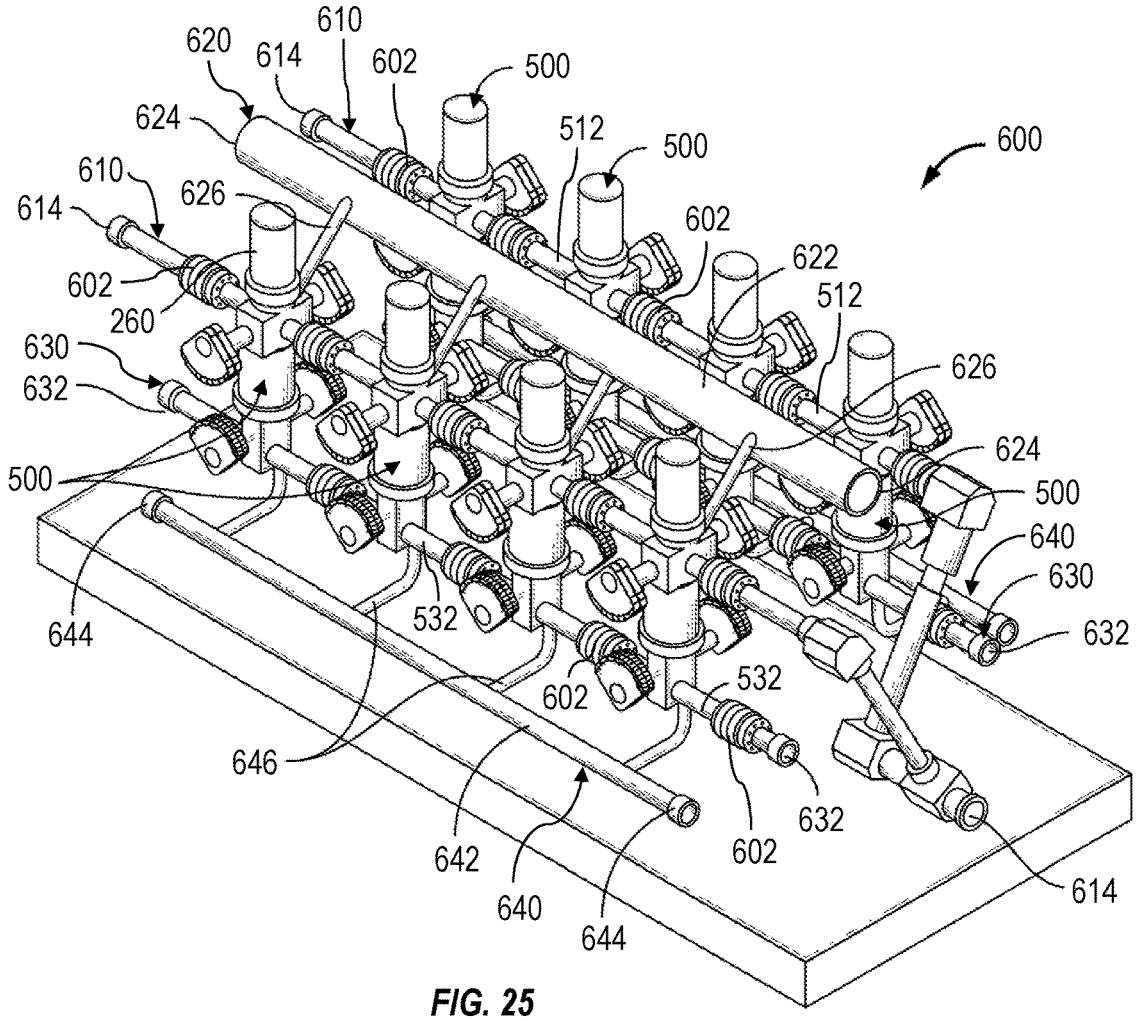
FIG. 25 is a perspective view of at least a portion of an example implementation of apparatus according to one or more aspects of the present disclosure.
Figure 26:
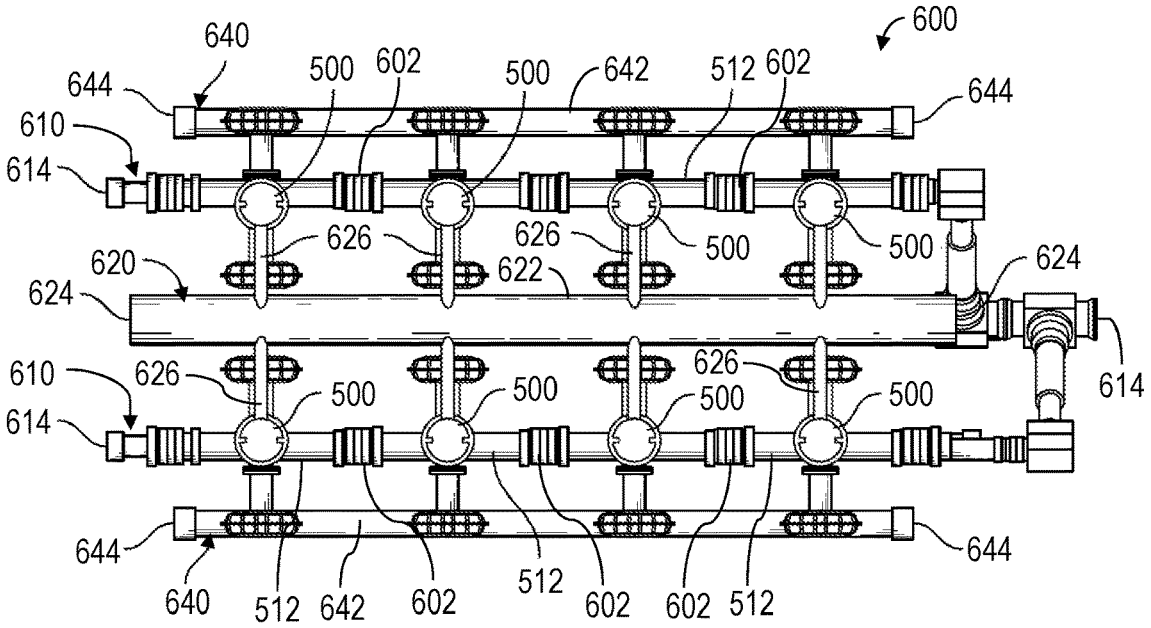
FIG. 26 is a top view of the apparatus shown in FIG. 25 according to one or more aspects of the present disclosure.

FIGS. 25 and 26 are perspective and top views of an example implementation of a manifold assembly 600 comprising a plurality of pressure exchangers 500 shown in FIGS. 19 and 20 according to one or more aspects of the present disclosure. The manifold assembly 600 comprises one or more similar features of the manifold assemblies 360, 410, 420 including where indicated by like reference numbers, except as described below. The following description refers to FIGS. 15-26, collectively.

The manifold assembly 600 comprises two high-pressure clean fluid distribution manifolds 610, each configured to receive and split up or otherwise distribute the high-pressure clean fluid among the corresponding pressure exchangers 500. At least a portion of each manifold 610 comprises a plurality of pressure exchangers 500 fluidly connected in series via a plurality of connection means 602, such as those described above and shown in FIGS. 21-24. The connection means 602 may mechanically and fluidly connect the conduits 512 and, thus, the internal passages 510 of adjacent pressure exchangers 500 to form the manifolds 610. The manifolds 610 may comprise opposing end openings or ports 614, wherein one or more of the ports may be fluidly connected with a source of clean fluid, such as the manifold 308. The manifold 610 may comprise one or more similar features of the clean fluid distribution manifolds 362, 444 described above.

The manifold assembly 600 further comprises a depressurized (i.e., low-pressure) clean fluid collection manifold 620 fluidly connected with the pressure exchangers 500 and configured to combine streams of a depressurized clean fluid discharged from the pressure exchangers 500 into a single stream. The manifold 620 may comprise a main fluid conduit 622, such as a fluid pipe, comprising opposing end openings or ports 624 and intermediate fluid conduits 626 fluidly connecting the main fluid conduit 622 with low-pressure clean fluid outlets (e.g., fluid passages 520) of the pressure exchangers 500. One or both of the ports 624 may be fluidly connected with a destination of clean fluid, such as the mixer 308 and/or the manifold 308. The manifold 620 may comprise one or more similar features of the clean fluid collection manifolds 364, 484 described above. The conduits 626 comprise one or more similar features of the conduit 528 described above.

The manifold assembly 600 further includes two pressurized (i.e., high-pressure) dirty fluid collection manifolds 630, each configured to combine streams of a pressurized dirty fluid discharged from the corresponding pressure exchangers 500 into a single stream. At least a portion of each manifold 630 comprises a plurality of pressure exchangers 500 fluidly connected in series via a plurality of connection means 602, such as those described above and shown in FIGS. 21-24. The connection means 602 may mechanically and fluidly connect the conduits 532 and, thus, the internal passages 530 of adjacent pressure exchangers 500 to form the manifolds 630. The manifolds 630 may comprise opposing end openings or ports 632, wherein one or more of the ports 632 may be fluidly connected with the wellbore 311 or another intermediate dirty fluid destination. The manifolds 630 may comprise one or more similar features of the dirty fluid collection manifolds 368, 464 described above.

The manifold assembly 600 also includes two low-pressure dirty fluid distribution manifolds 640 fluidly connected with the pressure exchangers 500 and configured to receive and split up or otherwise distribute a low-pressure dirty fluid among the plurality of pressure exchangers 500. Each manifold 640 may comprise a main fluid conduit 642, such as a fluid pipe, comprising opposing end openings or ports 644 and intermediate fluid conduits 646 fluidly connecting the main fluid conduit 642 with low-pressure dirty fluid inlets (e.g., fluid passages 540) of the pressure exchangers 500. One or both of the ports 644 may be fluidly connected with a source of dirty fluid, such as the mixer 308. The manifold 640 may comprise one or more similar features of the dirty fluid distribution manifolds 366, 494 described above. The conduits 646 comprise one or more similar features of the conduit 546 described above.

A manifold assembly within the scope of the present disclosure, such as the manifold assembly 360, 410, 420, 600 may be customized at a wellsite and/or at an operational base, such that the resulting manifold assembly may be suited or optimized for flow rates, pressures, and proppant loading that is intended or otherwise expected at a well pad. For example, a manifold assembly may be customized for flow rate by connecting together a number of pressure exchangers collectively operable to generate the intended or expected dirty fluid (i.e., slurry) flow rates. A manifold assembly may be customized for pressure, for example, by connecting pressure exchangers rated for intended or expected operating pressures. A manifold assembly may be customized for proppant loading, for example, by utilizing pressure exchangers designed for intended or expected proppant loading (e.g., high, medium, low proppant loading). Customization for proppant loading may also be achieved by adjusting the number of pressure exchangers with respect to lead flow (i.e., high-pressure fluid flowing directly from high-pressure inlets to high-pressure outlets) and feed slurry density. A given downhole proppant loading may be generated with multiple combinations of feed slurry proppant loading and lead flow. Increasing lead flow may decrease downhole fluid density if the supplied dirty fluid density is held constant.

A manifold assembly within the scope of the present disclosure may be repaired at a wellsite and/or at an operational base without necessitating disassembly or removal of individual manifolds or large portions of the manifold assembly. The manifold assembly may be repaired by removing and replacing one or more pressure exchangers without disassembling, removing, or otherwise moving remaining adjacent pressure exchangers.

For example, a worn, damaged, or otherwise malfunctioning pressure exchanger 400 may be removed from the manifold assembly 410, shown in FIG. 17, by disconnecting the malfunctioning pressure exchanger 400 from the manifolds 444, 454, 464, 474. The malfunctioning pressure exchanger 400 may be disconnected from the manifolds 444, 454, 464, 474 by disconnecting the conduits 442, 452, 462, 472 from the corresponding fluid passages 412, 414, 416, 418 on opposing sides of the malfunctioning pressure exchanger 400. Disconnecting the conduits 442, 452, 462, 472 mechanically and fluidly disconnects the malfunctioning pressure exchanger 400 from adjacent pressure exchangers 400, permitting the malfunctioning pressure exchanger 400 to be slipped out or otherwise removed without disconnecting or moving the remaining adjacent pressure exchangers 400. A new or repaired pressure exchanger 400 may be inserted into the space of the removed pressure exchanger 400, such that the fluid passages 412, 414, 416, 418 are aligned. Thereafter, the conduits 442, 452, 462, 472 may be fluidly connected with the corresponding fluid passages 412, 414, 416, 418 on opposing sides of the new pressure exchanger 400.

Furthermore, a worn, damaged, or otherwise malfunctioning pressure exchanger 450 may be removed from the manifold assembly 420, shown in FIG. 18, by disconnecting the malfunctioning pressure exchanger 450 from the manifolds 444, 464, 484, 494. The malfunctioning pressure exchanger 450 may be disconnected from the manifolds 444, 464 by disconnecting the conduits 442, 462 from the corresponding fluid passages 412, 416 on opposing sides of the malfunctioning pressure exchanger 400. The malfunctioning pressure exchanger 450 may be disconnected from the manifolds 484, 494 by disconnecting individual conduits of the manifolds 484, 494 from the corresponding fluid passages 482, 492 of the malfunctioning pressure exchanger 450. Disconnecting the conduits 442, 462 and the manifolds 484, 494 permits the malfunctioning pressure exchanger 450 to be slipped out or otherwise removed without disconnecting or moving the remaining adjacent pressure exchangers 450. A new or repaired pressure exchanger 450 may be inserted into the space of the removed pressure exchanger 450, such that the fluid passages 412, 416 are aligned. Thereafter, the conduits 442, 462 may be fluidly connected with the corresponding fluid passages 412, 416 on opposing sides of the new pressure exchanger 450 and the manifolds 484, 494 may be fluidly connected with the fluid passages 482, 492 of the new pressure exchanger.

Also, a worn, damaged, or otherwise malfunctioning pressure exchanger 500 may be removed from the manifold assembly 600, shown in FIGS. 25 and 26, by disconnecting the malfunctioning pressure exchanger 500 from the manifolds 610, 620, 630, 640. The malfunctioning pressure exchanger 500 may be disconnected from the depressurized clean fluid collection manifold 620 by disconnecting the conduit 626 from the fluid passage 520 of the pressure exchanger 500 and from the low-pressure dirty fluid distribution manifold 640 by disconnecting the conduit 646 from the fluid passage 540 of the pressure exchanger 500. The malfunctioning pressure exchanger 500 may be disconnected from the high-pressure manifolds 610, 630 by disconnecting or otherwise operating the connection means 602 on opposing sides of the pressure exchanger 500. Disconnecting the connection means 602 associated with the malfunctioning pressure exchanger 500 mechanically and fluidly disconnects the conduits 512, 532 of the pressure exchanger 500 from the conduits 512, 532 of the adjacent pressure exchangers 500. Once the malfunctioning pressure exchanger 500 is disconnected from the manifolds 610, 620, 630, 640, the pressure exchanger 500 can be slipped out or otherwise removed without moving or disconnecting the remaining adjacent pressure exchangers 500. A new or repaired pressure exchanger 500 may be inserted into the space of the removed pressure exchanger 500, such that the conduits 512, 532 of the new pressure exchanger 500 and the conduits 512, 532 of the remaining adjacent pressure exchangers 500 are aligned. Thereafter, the connection means 602 may be connected or otherwise operated to fluidly and mechanically connect the adjacent conduits 512, 532 to form the high-pressure clean fluid distribution manifold 610 and the pressurized dirty fluid collection manifold 630. Thereafter, the conduit 626 of the depressurized clean fluid collection manifold 620 may be connected with the fluid passage 520 of the new pressure exchanger 500 and the conduit 646 of the low-pressure dirty fluid distribution manifold 640 may be connected with the fluid passage 540 of the new pressure exchanger 500.

Although the manifold assembly 600 is shown comprising eight pressure exchangers 500 distributed into sets of four pressure exchangers 500, manifold assemblies within the scope of the present disclosure may comprise ten, twelve, fourteen, sixteen, or more pressure exchangers 500, distributed along two, three, four, or more rows of pressure exchangers 500.

Although not shown, the manifold assembly 600 may include a frame assembly extending around the manifolds 610, 620, 630, 640 to help maintain the manifolds 610, 620, 630, 640 or their components operatively connected and/or in relative positions. The frame assembly may be a box-shaped frame encompassing or surrounding the components of the manifold assembly 600 on each side. The frame assembly may be or comprise a plurality of interconnected structural steel members or beams extending about and connected with the components of the manifold assembly 600. The frame assembly may be a load-bearing frame assembly operable to support the weight of one or more additional instances of the manifold assembly 600 vertically stacked on top of the manifold assembly 600. Thus, the frame assembly may protect the components of the manifold assembly 600 from physical damage during transport, assembly, and operations and help facilitate transportation of the manifold assembly 600. The frame assembly may facilitate the manifold assembly 600 to be implemented as a skid, which may be moved and/or temporarily or permanently installed at the wellsite surface 310. The frame assembly may also permit the manifold assembly 600 to be mounted on a trailer, such as may permit transportation to the wellsite surface 310. For example, the frame assembly and/or other portions of the manifold assembly 600 may be constructed pursuant to International Organization for Standardization (ISO) specifications, permitting the manifold assembly 600 to be transported like an intermodal ISO container.

Figure 27:
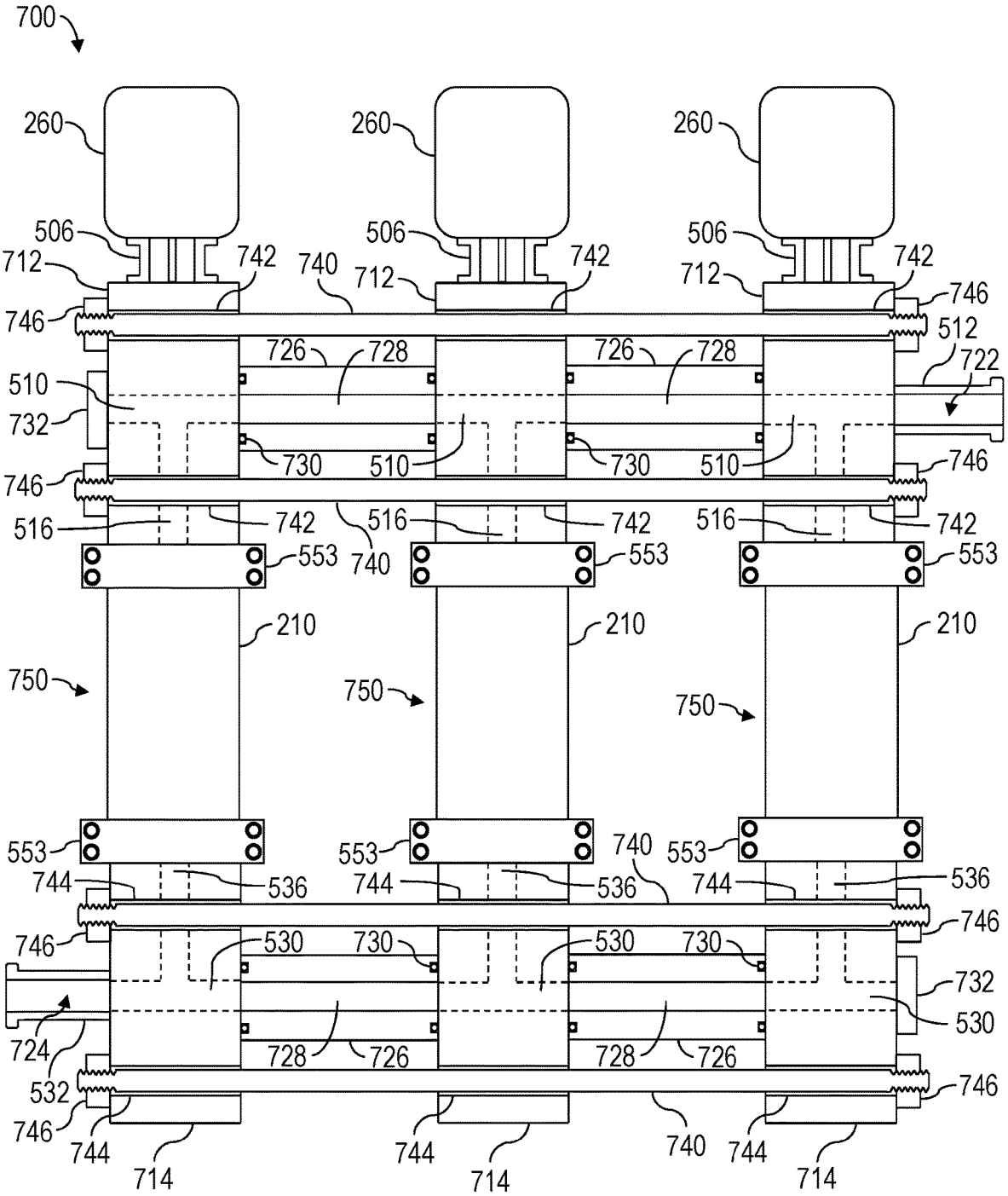
FIG. 27 is a schematic view of at least a portion of an example implementation of apparatus according to one or more aspects of the present disclosure.

Instead of or in addition to detachably connecting adjacent pressure exchangers via corresponding fluid connectors, pressure exchangers within the scope of the present disclosure may be detachably connected together via other means. FIG. 27 is a sectional schematic view of an example implementation of a manifold assembly 700 comprising pressure exchangers 750 coupled together via a plurality of tie rods 740. The pressure exchangers 750 comprise one or more similar features of the pressure exchangers described above, including where indicated by like reference numbers, except as described below.

Each pressure exchanger 750 may comprise heads 712, 714, each connected on an opposing side of a rotor (not shown) rotatably disposed within a housing 210. The heads 712 may be connected together to form a clean fluid distribution manifold 722 (i.e., a high-pressure clean fluid manifold), while the heads 714 may be connected together to form a dirty fluid collection manifold 724 (i.e., a pressurized dirty fluid manifold). Similarly to the manifold assemblies 420, 600, the manifold assembly 700 may further comprise an external clean fluid collection manifold (not shown) and an external dirty fluid distribution manifold (not shown) fluidly connected with each pressure exchanger 750.

Internal fluid passages 510 extending through the heads 712 may be fluidly connected in series by pipe segments 726 comprising axial bores 728 aligned with the fluid passages 510 and extending between sidewalls of the heads 712. One or both of the sidewalls of the heads 712 and faces of the pipe segments 726 may comprise fluid seals 730 to fluidly seal the pipe segments 726 against the sidewalls of the heads 712. A fluid passage 510 at one end of the clean fluid distribution manifold 722 may be fluidly closed, such as via a plug, a blanking plate, or another blocking member 732, while the fluid passage 510 at an opposing end of the clean fluid distribution manifold 722 may terminate with a conduit 512, such as may permit fluid connection with a source of the high-pressure clean fluid. Internal fluid passages 530 extending through the heads 714 may be fluidly connected in series by corresponding pipe segments 726 comprising axial bores 728 aligned with the fluid passages 530 and extending between sidewalls of the heads 714. One or both of the sidewalls of the heads 714 and faces of the pipe segments 726 may comprise fluid seals 730 to fluidly seal the pipe segments 726 against the sidewalls of the heads 714. A fluid passage 530 at one end of the dirty fluid collection manifold 724 may be fluidly closed via a blocking member 732, while the fluid passage 530 at an opposing end of the dirty fluid collection manifold 724 may terminate with a conduit 532, such as may permit fluid connection with a wellbore.

The pressure exchangers 750 may be connected together via a plurality of tie rods 740 operable to maintain the heads 712, 714 in contact with the pipe segments 726. The tie rods 740 may extend through a plurality of through bores 742, 744 extending through the heads 712, 714 and may be put under tension by retaining nuts 746 on one or both ends of the tie rods 740. A predetermined tension may be applied to the tie rods 740 to force the heads 712, 714 against the pipe segments 726 by applying a predetermined torque to the retaining nuts 746. The use of the pipe segments 726 and the tie rods 740 results in a manifold assembly 700 having a substantially reduced size or footprint compared to a manifold assembly utilizing treating iron connections.

Utilizing the pipe segments 726 to fluidly connect the fluid passages 510, 530 of adjacent pressure exchangers 750 permits removal of a selected one or more of the pressure exchangers 750 without disassembling of the entire manifold assembly 700. For example, some of the tie rods 740 may be removed in one direction from the selected pressure exchanger 750, but not from the entire manifold assembly 700, while the remaining tie rods 740 may be removed in the opposite direction from the selected pressure exchanger 750, but not from the entire manifold assembly 700. The pressure exchanger 750 may then be removed from the manifold assembly 700 without removing the remaining pressure exchangers 750 or otherwise without disassembling of the remaining portions of the manifold assembly 700. A new pressure exchanger 750 may then be inserted and mechanically and fluidly connected as part of the manifold assembly 700 by performing the steps described above, but in reverse order.

Figure 28:
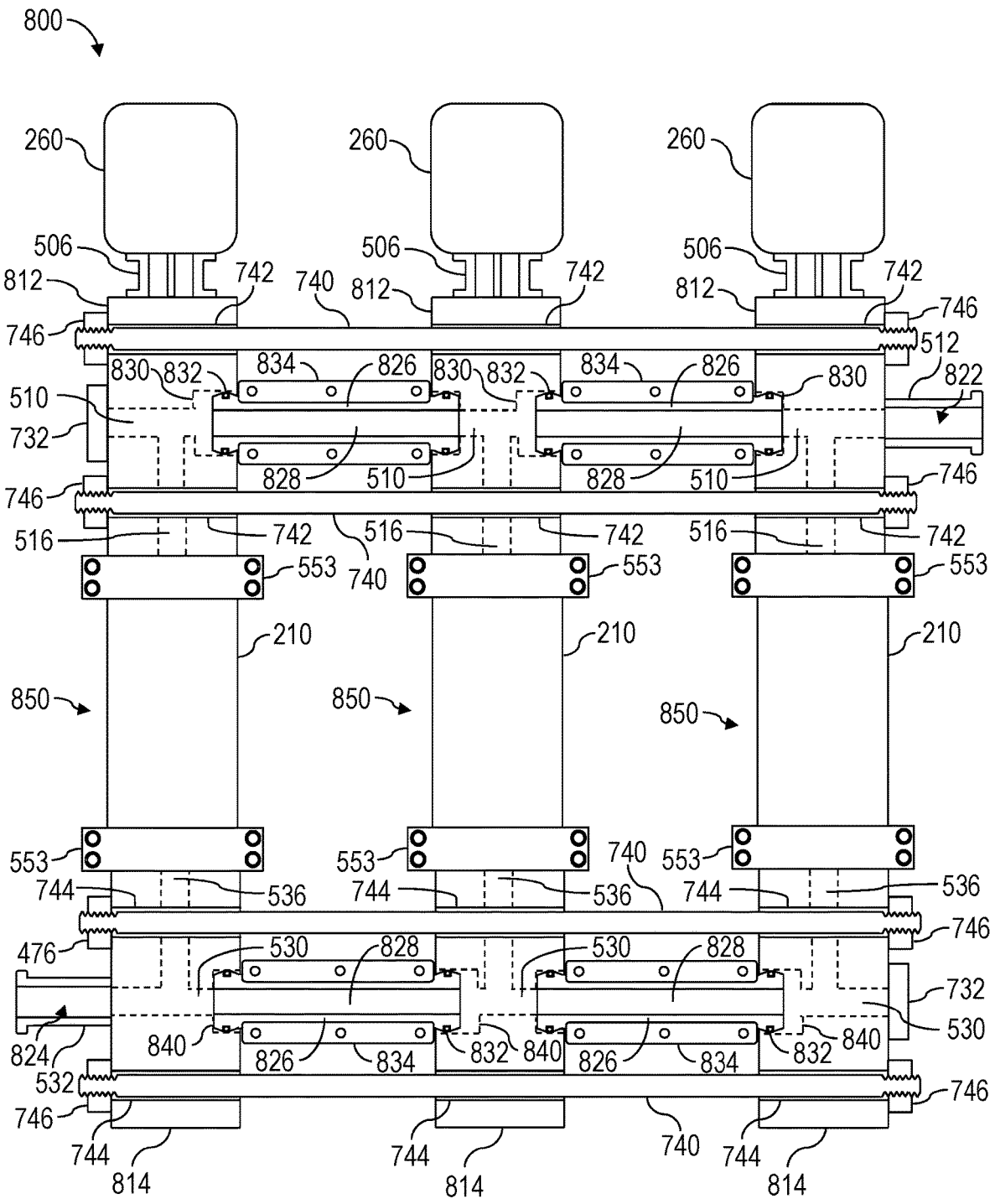
FIG. 28 is a schematic view of at least a portion of an example implementation of apparatus according to one or more aspects of the present disclosure.

FIG. 28 is a sectional schematic view of another example implementation of a manifold assembly 800 comprising pressure exchangers 850 coupled together via a plurality of tie rods 740. The pressure exchangers 850 comprise one or more similar features of the pressure exchangers described above, including where indicated by like reference numbers, except as described below.

Each pressure exchanger 850 may comprise heads 812, 814, each connected on an opposing side of the rotor (not shown) rotatably disposed within a housing 210. The heads 812 may be connected together to form a clean fluid distribution manifold 822, while the heads 814 may be connected together to form a dirty fluid collection manifold 824. Similarly to manifold assemblies 420, 600, 700, the manifold assembly 800 may further comprise an external clean fluid collection manifold (not shown) and an external dirty fluid distribution manifold (not shown) fluidly connected with each pressure exchanger 850.

Internal fluid passages 510 extending through the heads 812 may be fluidly connected in series by port bushings 826 comprising axial bores 828 aligned with the fluid passages 510 and extending between adjacent heads 812. Opposing ends of each port bushing 826 may extend into corresponding ports 830 (e.g., enlarged portions of the fluid passages 510) and may comprise fluid seals 832 configured to fluidly seal the port bushings 826 against sidewalls of the ports 830. The opposing ends of each port bushing 826 may be raised or tapered, such as may permit the corresponding ports 830 to be slightly misaligned while still maintaining a fluid seal between the port bushings 826 and the ports 830. Each port bushing 826 may be locked in a predetermined position or depth within the ports 830 by a corresponding retaining collar 834 configured to be selectively locked around the port bushing 826. The retaining collar 834 may be fixedly connected about the port bushing 826 to prevent the port bushing 826 from moving axially within the corresponding ports 830 and, thus, maintain each port bushing 826 within the ports 830. The retaining collar 834 may be implemented as a split collar, whereby each portion of the split collar is disposed against a corresponding port bushing 826 and bolted together.

Internal fluid passages 530 extending through the heads 814 may be fluidly connected in series by port bushings 826 comprising axial bores 828 aligned with the fluid passages 530 and extending between adjacent heads 814. Opposing ends of each port bushing 826 may extend into corresponding ports 840 (e.g., enlarged portions of the fluid passages 530) and may comprise fluid seals 832 configured to fluidly seal the port bushings 826 against sidewalls of the ports 840. The opposing ends of each port bushing 826 may be raised or tapered, such as may permit the corresponding ports 840 to be slightly misaligned while still maintaining a fluid seal between the port bushings 826 and the ports 840. Each port bushing 826 may be locked in a predetermined position or depth within the ports 840 by a corresponding retaining collar 834 configured to be selectively locked around the port bushing 826. The retaining collar 834 may be fixedly connected about the port bushing 826 to prevent the port bushing 826 from moving axially within corresponding ports 840 and, thus, maintain each port bushing 826 within the ports 840.

The pressure exchangers 850 may be connected together via a plurality of tie rods 740 operable to maintain the heads 812, 814 in contact with the retaining collars 834 and fluidly connected with the port bushings 826. The tie rods 740 may extend through a plurality of through bores 742, 744 in the heads 812, 814 and be put under tension by retaining nuts 746 on one or both ends of the tie rods 740. A predetermined tension may be applied to the tie rods 740 to force the heads 812, 814 against the retaining collars 834 by applying a predetermined torque to the retaining nuts 746.

Utilizing the port bushings 826 and retaining collars 834 to fluidly connect the fluid passages 510, 530 of adjacent pressure exchangers 850 permits removal of a selected one or more of the pressure exchangers 850 without disassembling the entire manifold assembly 800. For example, some of the tie rods 740 may be removed in one direction from the selected pressure exchanger 850, but not from the entire manifold assembly 800, while the remaining tie rods 740 may be removed in the opposite direction from the selected pressure exchanger 850, but not from the entire manifold assembly 800. Thereafter, the retaining collars 834 on one side of the selected pressure exchanger 850 may be disconnected from the port bushings 826. The port bushings 826 may then be moved axially deeper into one of the ports 830 until the opposing ends of the port bushings 826 are removed from the opposing ports 830 and, thus, are free to be removed from between the adjacent heads 812, 814. The pressure exchanger 850 may then be removed from the manifold assembly 800 without removing the remaining pressure exchangers 850 or otherwise without disassembling of the remaining portions of the manifold assembly 800. A new pressure exchanger 850 may then be inserted and mechanically and fluidly connected as part to the manifold assembly by performing the steps described above, but in reverse order.

Figure 29:
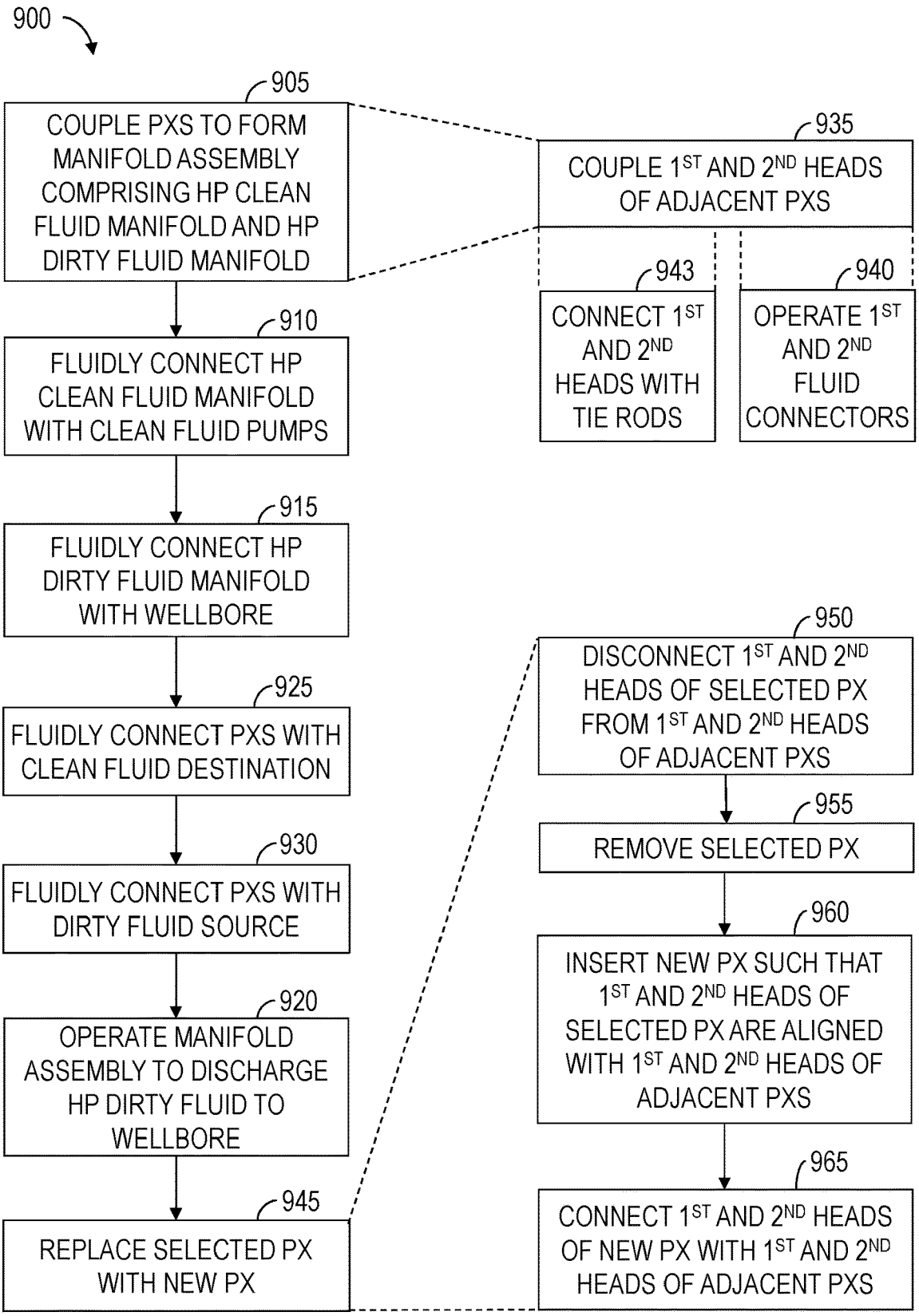
FIG. 29 is a flow-chart diagram of at least a portion of an example implementation of a method according to one or more aspects of the present disclosure.

FIG. 29 is a flow-chart diagram of at least a portion of an example implementation of a method (900) according to one or more aspects of the present disclosure. The method (900) may be performed utilizing or otherwise in conjunction with at least a portion of one or more implementations of one or more instances of the apparatus shown in one or more of FIGS. 1-28 and/or otherwise within the scope of the present disclosure. The method (900) may be performed manually by a wellsite operator and/or performed or caused, at least partially, by a computer executing coded instructions according to one or more aspects of the present disclosure. Thus, the following description of the method (900) also refers to apparatus shown in one or more of FIGS. 1-28. However, the method (900) may also be performed in conjunction with implementations of apparatus other than those depicted in FIGS. 1-28 that are also within the scope of the present disclosure.

The method (900) may comprise coupling (905) a plurality of pressure exchangers (PXS) 500 to form a fluid manifold assembly 600 comprising a high-pressure (HP) clean fluid manifold 610 and a high-pressure dirty fluid manifold 630, fluidly connecting (910) the high-pressure clean fluid manifold 610 with a source of high-pressure clean fluid, such as the pumps 306, and fluidly connecting (915) the high-pressure dirty fluid manifold 630 with a wellbore 311 at an oil and/or gas wellsite 310. Each pressure exchanger (PX) 500 may comprise a first head 502 having a first fluid passage 510 extending between opposing sides of the first head, a second head 504 having a second fluid passage 530 extending between opposing sides of the second head 504, and a rotor 201 between the first and second heads 502, 504. Coupling (905) the plurality of pressure exchangers 500 may comprise fluidly connecting the first fluid passages 510 of the plurality of pressure exchangers 500 to collectively form at least a portion of a high-pressure clean fluid manifold 610 of the fluid manifold assembly 600 and fluidly connecting the second fluid passages 530 of the plurality of pressure exchangers 500 to collectively form at least a portion of a high-pressure dirty fluid manifold 630 of the fluid manifold assembly 600.

The method (900) may further comprise operating (920) the manifold assembly 600 by injecting a low-pressure (LP) dirty fluid at a first pressure into each pressure exchanger 500, injecting a high-pressure clean fluid at a second pressure into each pressure exchanger 500 via the high-pressure clean fluid manifold 610, wherein the second pressure is substantially greater than the first pressure. Operating (920) the manifold assembly may further comprise pressurizing the low-pressure dirty fluid utilizing the high-pressure clean fluid to form a high-pressure dirty fluid at a third pressure, wherein the third pressure is substantially greater than the first pressure, and discharging the high-pressure dirty fluid at the third pressure from each pressure exchanger 500 via the high-pressure dirty fluid manifold 630. The dirty fluid may comprise a treatment fluid for injection into the wellbore and the clean fluid may comprise a substantially non-abrasive solids-free fluid.

Operating (920) the manifold assembly 600 may further comprise pumping a high-pressure clean fluid into the high-pressure clean fluid manifold 610, distributing the high-pressure clean fluid among the plurality of pressure exchangers 500 via the high-pressure clean fluid manifold 610, combining a high-pressure dirty fluid discharged by the plurality of pressure exchangers 500 via the high-pressure dirty fluid manifold 630, and transferring the high-pressure dirty fluid to the wellbore 311.

The method (900) may further comprise fluidly connecting (925) each first head 502 of the plurality of pressure exchangers 500 with a clean fluid destination 304, 308, 340 via a depressurized clean fluid manifold 620, and fluidly connecting (930) each second head 504 of the plurality of pressure exchangers 500 with a dirty fluid source 304 via a low-pressure dirty fluid manifold 640. Thus, operating (920) the manifold assembly 600 may further comprise combining a depressurized clean fluid discharged by the plurality of pressure exchangers 500 via the depressurized clean fluid manifold 620 for transfer to the clean fluid destination 304, 308, 340, and distributing the low-pressure dirty fluid from the dirty fluid source 304 among the plurality of pressure exchangers 500 via the low-pressure dirty fluid manifold 640.

Each rotor 201 of the plurality of pressure exchangers 500 may comprise a plurality of chambers 150 extending between opposing first and second ends of the rotor 201, wherein each first fluid passage 510 of the plurality of pressure exchangers 500 may be fluidly connected with consecutively changing ones of the chambers 150 at the first end of the rotor 201 in response to relative rotation between the rotor 201 and the first head 502, and wherein each second fluid passage 530 of the plurality of pressure exchangers 500 may be fluidly connected with the consecutively changing ones of the chambers 150 at the second end of the rotor 201 in response to relative rotation between the rotor 201 and the second head 504.

Coupling (905) the plurality of pressure exchangers 500 may comprise coupling (935) adjacent ones of the plurality of pressure exchangers 500 by coupling the first heads 502 of the adjacent pressure exchangers 500 such that the first passages 510 of the adjacent pressure exchangers 500 are fluidly connected, and coupling the second heads 504 of the adjacent pressure exchangers 500 such that the second passages 530 of the adjacent pressure exchangers 500 are fluidly connected. The first and second passages 510 of the adjacent pressure exchangers 500 may be fluidly connected in series.

Each first head 502 may further comprise a first fluid connector 514, 602 and each second head 504 may further comprise a second fluid connector 534, 602. Thus, coupling (935) adjacent ones of the plurality of pressure exchangers 500 may comprise operating (940) first and second fluid connectors 514, 534, 602. For example, coupling the first heads 502 of the adjacent pressure exchangers may comprise operating the first fluid connector 514, 602 to couple the first heads 502 of the adjacent pressure exchangers 500, and coupling the second heads 504 of the adjacent pressure exchangers 500 may comprise operating the second fluid connector 534, 602 to couple the second heads 504 of the adjacent pressure exchangers 500. For example, the first and second fluid connectors may comprise flanges and/or threaded connectors.

Instead of or in addition to the fluid connectors 514, 534, 602, coupling (935) the first and second heads 502, 504 of the adjacent pressure exchangers 500 may comprise connecting (943) the first and second heads 502, 504 via a plurality of first tie rods 740 extending through the first heads 502, and a plurality of second tie rods 740 extending through the second heads 504.

The method (900) may further comprise replacing (945) a selected one of the plurality of pressure exchangers 500 with a new pressure exchanger 500. The replacing (945)

operations may comprise disconnecting (950) a first head 502 of the selected pressure exchanger 500 from first heads 502 of adjacent ones of the plurality of pressure exchangers 500 and disconnecting a second head 504 of the selected pressure exchanger 500 from second heads 504 of the adjacent pressure exchangers 500. Thereafter, the selected pressure exchanger 500 may be removed (955) and the new pressure exchanger 500 may be inserted (960) between the adjacent pressure exchangers 500 such that first and second heads 502, 504 of the new pressure exchanger 500 are aligned with the first and second heads 502, 504 of the adjacent pressure exchangers 500. The replacing (945) operations may further comprise connecting (965) the first head 502 of the new pressure exchanger 500 with the first heads 502 of the adjacent pressure exchangers 500 and connecting the second head 504 of the new pressure exchanger 500 with the second heads 504 of the adjacent pressure exchangers 500. Replacing (945) the selected one of the plurality of pressure exchangers 500 with the new pressure exchanger 500 may be performed while the adjacent pressure exchangers 500 are maintained in a substantially constant position.

In view of the entirety of the present disclosure, including the figures and the claims, a person having ordinary skill in the art will readily recognize that the present disclosure introduces an apparatus comprising a plurality of pressure exchangers, each pressure exchanger comprising a first conduit and a second conduit and operable for pressurizing a low-pressure dirty fluid via a high-pressure clean fluid. Each first conduit conveys the high-pressure clean fluid into a corresponding one of the pressure exchangers and to an adjacent one of the pressure exchangers. Each second conduit conveys a pressurized dirty fluid out of a corresponding one of the pressure exchangers and from the adjacent one of the pressure exchangers. The first conduits collectively form at least a portion of a high-pressure clean fluid manifold distributing the high-pressure clean fluid among the pressure exchangers. The second conduits collectively form at least a portion of a pressurized dirty fluid manifold combining the pressurized dirty fluid collectively discharged from the pressure exchangers.

Each pressure exchanger is operable to: receive the low-pressure dirty fluid at a first pressure; receive the high-pressure clean fluid at a second pressure via the high-pressure clean fluid manifold, wherein the second pressure is substantially greater than the first pressure; pressurize the low-pressure dirty fluid to a third pressure utilizing the high-pressure clean fluid, wherein the third pressure is substantially greater than the first pressure; and discharge the pressurized dirty fluid via the pressurized dirty fluid manifold.

The dirty fluid may comprise a treatment fluid for injection into an oil and/or gas wellbore.

The clean fluid may comprise a substantially non-abrasive, solids-free fluid.

The apparatus may further comprise: a depressurized clean fluid manifold combining a depressurized clean fluid collectively discharged from the pressure exchangers; and a low-pressure dirty fluid manifold fluidly receiving the low-pressure dirty fluid from a dirty fluid source and distributing the low-pressure dirty fluid among the pressure exchangers.

Each pressure exchanger may comprise: a housing; a rotor disposed within the housing and having a plurality of chambers extending between opposing first and second ends of the rotor; a first head disposed at the first rotor end and comprising a first fluid passage fluidly connecting the high-pressure clean fluid manifold with consecutively changing ones of the chambers in response to relative rotation between the rotor and the first head; and a second head disposed at the second rotor end and comprising a second fluid passage fluidly connecting the pressurized dirty fluid manifold with the consecutively changing ones of the chambers in response to the relative rotation between the rotor and the second head. In such implementations, among others within the scope of the present disclosure, the first fluid passages of the pressure exchangers may be fluidly connected in parallel to a high-pressure clean fluid source via the high-pressure clean fluid manifold, and the second fluid passages of the pressure exchangers may be fluidly connected in parallel to a discharge conduit via the pressurized dirty fluid manifold. In such implementations, among others within the scope of the present disclosure, the apparatus may further comprise: a depressurized clean fluid manifold combining a depressurized clean fluid collectively discharged from the pressure exchangers; and a low-pressure dirty fluid manifold fluidly receiving the low-pressure dirty fluid from a dirty fluid source and distributing the low-pressure dirty fluid among the pressure exchangers. Moreover, with respect to each pressure exchanger: the first head may comprise a third fluid passage fluidly connecting the depressurized clean fluid manifold with the consecutively changing ones of the chambers in response to the relative rotation between the rotor and the first head; and the second head may comprise a fourth fluid passage fluidly connecting the low-pressure dirty fluid manifold with the consecutively changing ones of the chambers in response to the relative rotation between the rotor and the second head. The first heads of adjacent ones of the pressure exchangers may be detachably connected by a first mechanical coupling that, when connected, fluidly connects the first conduits of the corresponding pressure exchangers, and the second heads of adjacent ones of the pressure exchangers may be detachably connected by a second mechanical coupling that, when connected, fluidly connects the second conduits of the corresponding pressure exchangers. In such implementations, among others within the scope of the present disclosure, each first conduit of the plurality of pressure exchangers may comprise at least a portion of the first mechanical coupling, and each second conduit of the plurality of pressure exchangers may comprise at least a portion of the second mechanical coupling. The first and second mechanical couplings may comprise flanges and/or threaded connectors. The first heads of the plurality of pressure exchangers may be mechanically connected by a plurality of first tie rods extending through the plurality of first heads such that, when connected, the first conduits collectively form the at least a portion of the high-pressure clean fluid manifold, and the second heads of the plurality of pressure exchangers may be mechanically connected by a plurality of second tie rods extending through the plurality of second heads such that, when connected, the second conduits collectively form the at least a portion of the pressurized dirty fluid manifold.

The apparatus may further comprise a manifold assembly comprising the pressure exchangers, the high-pressure clean fluid manifold, and the pressurized dirty fluid manifold. In such implementations, among others within the scope of the present disclosure, the manifold assembly may further comprise a mobile trailer supporting the high-pressure clean fluid manifold and the pressurized dirty fluid manifold. The plurality of pressure exchangers included in such manifold assembly may comprise between six and twenty pressure exchangers.

The present disclosure also introduces an apparatus comprising a pressure exchanger operable for transferring pressure from a high-pressure fluid to a low-pressure fluid, wherein the pressure exchanger comprises: (A) a housing; (B) a rotor disposed within the housing and having a plurality of chambers extending between opposing first and second ends of the rotor; (C) a first head disposed at the first end of the rotor, wherein the first head comprises: (i) a first fluid passage extending between first and second external openings in the first head; and (ii) a second fluid passage fluidly connecting the first fluid passage with consecutively changing ones of the chambers at the first end of the rotor in response to relative rotation between the rotor and the first head; and (D) a second head disposed at the second end of the rotor, wherein the second head comprises: (i) a third fluid passage extending between third and fourth external openings in the second head; and (ii) a fourth fluid passage fluidly connecting the third fluid passage with the consecutively changing ones of the chambers at the second end of the rotor in response to the relative rotation between the rotor and the second head.

Each of the plurality of pressure exchangers may be operable to: receive a dirty fluid at a first pressure into at least one of the plurality of chambers; receive a clean fluid at a second pressure into the least one of the plurality of chambers via the first and second passages to pressurize the dirty fluid to a third pressure, wherein the second and third pressures are substantially greater than the first pressure; discharge the dirty fluid at the third pressure from the at least one of the plurality of chambers via the third and fourth passages; and discharge the clean fluid at a fourth pressure from the at least one of the plurality of chambers. The dirty fluid may comprise a treatment fluid for injection into an oil and/or gas wellbore. The clean fluid may comprise a substantially non-abrasive solids-free fluid.

The first head may be connected with the housing at a first end of the housing, and the second head may be connected with the housing at a second end of the housing.

The first and second external openings may be located on opposing sides of the first head, and the third and fourth external openings may be located on opposing sides of the second head.

The first and third fluid passages may extend substantially perpendicularly with respect to at least one of the plurality of chambers.

The first fluid passage may be for transferring a high-pressure clean fluid through the first head, the second fluid passage may be for transferring the high-pressure clean fluid from the first fluid passage into the plurality of chambers, the third fluid passage may be for transferring a pressurized dirty fluid through the second head, and the fourth fluid passage may be for transferring the pressurized dirty fluid from the plurality of chambers into the third fluid passage. In such implementations, among others within the scope of the present disclosure, the first fluid passage may be for receiving the high-pressure clean fluid from a source of clean fluid, and the third fluid passage may be for transferring the pressurized dirty fluid for injection into a wellbore.

The first head may have a fifth fluid passage fluidly connecting a fifth external opening in the first head with the consecutively changing ones of the chambers at the first end of the rotor in response to the relative rotation between the rotor and the first head, and the second head may have a sixth fluid passage fluidly connecting a sixth external opening in the second head with the consecutively changing ones of the chambers at the second end of the rotor in response to the relative rotation between the rotor and the second head. The fifth fluid passage may be fluidly isolated from the first and second fluid passages, and the sixth fluid passage may be fluidly isolated from the third and fourth fluid passages. The fifth fluid passage may be for transferring a clean fluid from the plurality of chambers to a clean fluid destination, and the sixth fluid passage may be for transferring a dirty fluid into the plurality of chambers from a source of dirty fluid.

The pressure exchanger may be operable for detachably coupling with another instance of the pressure exchanger such that the first fluid passages are fluidly connected together to form a first manifold and the third fluid passages are fluidly connected together to form a second manifold. The pressure exchanger may be further operable for uncoupling from the another instance of the pressure exchanger, and the coupling and uncoupling operations may be performed while the another instance of the pressure exchanger is maintained in a substantially constant position. The apparatus may comprise three or more pressure exchangers detachably coupled together such that the first fluid passages are fluidly connected together in series and the third fluid passages are fluidly connected together in series. The fluidly connected first fluid passages of the pressure exchangers may collectively form at least a portion of a high-pressure clean fluid manifold operable for distributing a high-pressure clean fluid among the pressure exchangers, and the fluidly connected third fluid passages of the pressure exchangers may collectively form at least a portion of a pressurized dirty fluid manifold operable for combining a pressurized dirty fluid from the pressure exchangers.

The first head of the pressure exchanger may be operable for detachably coupling with a first head of another instance of the pressure exchanger by a first mechanical coupling such that the first fluid passages of the pressure exchangers are fluidly connected together, and the second head of the pressure exchanger may be operable for detachably coupling with a second head of the another instance of the pressure exchanger by a second mechanical coupling such that the third fluid passages of the pressure exchangers are fluidly connected together. In such implementations, among others within the scope of the present disclosure, the first head may comprise at least a portion of the first mechanical coupling, and the second head may comprise at least a portion of the second mechanical coupling. The first and second mechanical couplings may comprise flanges and/or threaded connectors.

The first head of the pressure exchanger may be operable for detachably coupling with a first head of another instance of the pressure exchanger by a plurality of first tie rods extending through the first heads such that, when connected, the first fluid passages of the pressure exchangers are fluidly connected together, and the second head of the pressure exchanger may be operable for detachably coupling with a second head of the another instance of the pressure exchanger by a plurality of second tie rods extending through the second heads such that, when connected, the third fluid passages of the pressure exchangers are fluidly connected together.

The first head may comprise: a first body portion; and a first fluid conduit extending from the first body portion, wherein the first fluid passage extends through the first body portion and the first fluid conduit. The second head may comprise: a second body portion; and a second fluid conduit extending from the second body portion, wherein the third fluid passage extends through the second body portion and the second fluid conduit. In such implementations, among others within the scope of the present disclosure, the first fluid conduit may comprise at least a portion of a first mechanical coupling operable for detachably coupling with a first fluid conduit of another instance of the pressure exchanger such that the first fluid passages of the pressure exchangers are fluidly connected together, and the second fluid conduit may comprise at least a portion of a second mechanical coupling operable for detachably coupling with a second fluid conduit of the another instance of the pressure exchanger such that the third fluid passages of the pressure exchangers are fluidly connected together.

Each pressure exchanger may comprise: a first fluid valve connected along the second fluid passage operable to selectively permit and prevent fluid flow; and a second fluid valve connected along the fourth fluid passage operable to selectively permit and prevent fluid flow.

Each pressure exchanger may comprise an electric motor operatively connected with and operable to rotate a corresponding rotor.

The present disclosure also introduces a method comprising: (A) coupling a plurality of pressure exchangers to form a fluid manifold assembly, wherein each pressure exchanger comprises: (i) a first head comprising a first fluid passage extending between opposing sides of the first head; (ii) a second head comprising a second fluid passage extending between opposing sides of the second head; and (iii) a rotor between the first and second heads, wherein coupling the plurality of pressure exchangers comprises: (a) fluidly connecting the first fluid passages of the plurality of pressure exchangers to collectively form at least a portion of a high-pressure clean fluid manifold of the fluid manifold assembly; and (b) fluidly connecting the second fluid passages of the plurality of pressure exchangers to collectively form at least a portion of a high-pressure dirty fluid manifold of the fluid manifold assembly; (B) fluidly connecting the high-pressure clean fluid manifold with clean fluid pumps; and (C) fluidly connecting the high-pressure dirty fluid manifold with a wellbore at an oil and/or gas wellsite.

The method may further comprise operating the manifold assembly by: injecting a low-pressure dirty fluid at a first pressure into each pressure exchanger; injecting a high-pressure clean fluid at a second pressure into each pressure exchanger via the high-pressure clean fluid manifold, wherein the second pressure is substantially greater than the first pressure; pressurizing the low-pressure dirty fluid utilizing the high-pressure clean fluid to form a high-pressure dirty fluid at third pressure, wherein the third pressure is substantially greater than the first pressure; and discharging the high-pressure dirty fluid at the third pressure from each pressure exchanger via the high-pressure dirty fluid manifold. In such implementations, among others within the scope of the present disclosure, the dirty fluid may comprise a treatment fluid for injection into the wellbore, and/or the clean fluid may comprise a substantially non-abrasive solids-free fluid.

The method may further comprise operating the manifold assembly by: pumping a high-pressure clean fluid into the high-pressure clean fluid manifold; distributing the high-pressure clean fluid among the plurality of pressure exchangers via the high-pressure clean fluid manifold; combining a high-pressure dirty fluid discharged by the plurality of pressure exchangers via the high-pressure dirty fluid manifold; and transferring the high-pressure dirty fluid to the wellbore. In such implementations, among others within the scope of the present disclosure, the method may further comprise: (A) fluidly connecting each first head of the plurality of pressure exchangers with a clean fluid destination via a low-pressure clean fluid manifold; (B) fluidly connecting each second head of the plurality of pressure exchangers with a dirty fluid source via a low-pressure dirty fluid manifold; and (C) further operating the manifold assembly by: (i) combining a low-pressure clean fluid discharged by the plurality of pressure exchangers via the low-pressure clean fluid manifold for transfer to the clean fluid destination; and (ii) distributing a low-pressure dirty fluid from the dirty fluid source among the plurality of pressure exchangers via the low-pressure dirty fluid manifold.

Each rotor of the plurality of pressure exchangers may comprise a plurality of chambers extending between opposing first and second ends of the rotor, each first fluid passage of the plurality of pressure exchangers may be fluidly connected with consecutively changing ones of the chambers at the first end of the rotor in response to relative rotation between the rotor and the first head, and each second fluid passage of the plurality of pressure exchangers may be fluidly connected with the consecutively changing ones of the chambers at the second end of the rotor in response to the relative rotation between the rotor and the second head.

Coupling the plurality of pressure exchangers may comprise coupling adjacent ones of the plurality of pressure exchangers by: coupling the first heads of the adjacent pressure exchangers such that the first passages of the adjacent pressure exchangers are fluidly connected; and coupling the second heads of the adjacent pressure exchangers such that the second passages of the adjacent pressure exchangers are fluidly connected. In such implementations, among others within the scope of the present disclosure, the first and second passages of the adjacent pressure exchangers may be fluidly connected in series. Each first head may further comprise a first fluid connector, and each second head may further comprise a second fluid connector, such that coupling the first heads of the adjacent pressure exchangers may comprise operating the first fluid connector to couple the first heads of the adjacent pressure exchangers, and coupling the second heads of the adjacent pressure exchangers may comprise operating the second fluid connector to couple the second heads of the adjacent pressure exchangers. The first and second fluid connectors may comprise flanges and/or threaded connectors. Coupling the first heads of the adjacent pressure exchangers may comprise connecting the first heads via a plurality of first tie rods extending through the first heads, and coupling the second heads of the adjacent pressure exchangers may comprise connecting the second heads via a plurality of second tie rods extending through the second heads. The method may further comprise replacing a selected one of the plurality of pressure exchangers with a new pressure exchanger by: disconnecting the first head of the selected pressure exchanger from the first heads of adjacent ones of the plurality of pressure exchangers; disconnecting the second head of the selected pressure exchanger from the second heads of the adjacent pressure exchangers; removing the selected pressure exchanger; inserting the new pressure exchanger between the adjacent pressure exchangers such that first and second heads of the new pressure exchanger are aligned with the first and second heads of the adjacent pressure exchangers; connecting the first head of the new pressure exchanger with the first heads of the adjacent pressure exchangers; and connecting the second head of the new pressure exchanger with the second heads of the adjacent pressure exchangers. Replacing the selected one of the plurality of pressure exchangers with the new pressure exchanger may be performed while the adjacent pressure exchangers are maintained in a substantially constant position.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. A method comprising:

coupling a plurality of pressure exchangers to form a fluid manifold assembly, wherein each pressure exchanger comprises:

a first head comprising a first fluid passage extending between opposing sides of the first head;

a second head comprising a second fluid passage extending between opposing sides of the second head; and a rotor between the first and second heads, wherein coupling the plurality of pressure exchangers comprises:

fluidly connecting the first fluid passages of the plurality of pressure exchangers to collectively form at least a portion of a high-pressure clean fluid manifold of the fluid manifold assembly; and fluidly connecting the second fluid passages of the plurality of pressure exchangers to collectively form at least a portion of a high-pressure dirty fluid manifold of the fluid manifold assembly;

fluidly connecting the high-pressure clean fluid manifold with clean fluid pumps;

fluidly connecting the high-pressure dirty fluid manifold with a wellbore at an oil and/or gas wellsite; and replacing a selected one of the plurality of pressure exchangers without disassembling, removing, or otherwise moving one or more adjacent pressure exchangers, wherein replacing the selected one of the plurality of pressure exchangers comprises:

removing one or more first tie rods in a first direction from the selected one of the plurality of pressure exchangers but not from the entire fluid manifold assembly; and removing one or more second tie rods in a second direction, opposite the first direction, from the selected one of the plurality of pressure exchangers but not from the entire fluid manifold assembly.

2. The method of claim 1 further comprising operating the fluid manifold assembly by:

injecting a low-pressure dirty fluid at a first pressure into each pressure exchanger; injecting a high-pressure clean fluid at a second pressure into each pressure exchanger via the high-pressure clean fluid manifold, wherein the second pressure is substantially greater than the first pressure; pressurizing the low-pressure dirty fluid utilizing the high-pressure clean fluid to form a high-pressure dirty fluid at third pressure, wherein the third pressure is substantially greater than the first pressure; and discharging the high-pressure dirty fluid at the third pressure from each pressure exchanger via the high-pressure dirty fluid manifold.

3. The method of claim 2 wherein the dirty fluid comprises a treatment fluid for injection into the wellbore.

4. The method of claim 2 wherein the clean fluid comprises a substantially non-abrasive solids-free fluid.

5. The method of claim 1 further comprising operating the fluid manifold assembly by:

pumping a high-pressure clean fluid into the high-pressure clean fluid manifold;

distributing the high-pressure clean fluid among the plurality of pressure exchangers via the high-pressure clean fluid manifold;

combining a high-pressure dirty fluid discharged by the plurality of pressure exchangers via the high-pressure dirty fluid manifold; and transferring the high-pressure dirty fluid to the wellbore.

6. The method of claim 5 further comprising:

fluidly connecting each first head of the plurality of pressure exchangers with a clean fluid destination via a low-pressure clean fluid manifold;

fluidly connecting each second head of the plurality of pressure exchangers with a dirty fluid source via a low-pressure dirty fluid manifold; and further operating the fluid manifold assembly by:

combining a low-pressure clean fluid discharged by the plurality of pressure exchangers via the low-pressure clean fluid manifold for transfer to the clean fluid destination; and distributing a low-pressure dirty fluid from the dirty fluid source among the plurality of pressure exchangers via the low-pressure dirty fluid manifold.

7. The method of claim 1 wherein each rotor of the plurality of pressure exchangers comprises a plurality of chambers extending between opposing first and second ends of the rotor, wherein each first fluid passage of the plurality of pressure exchangers is fluidly connected with consecutively changing ones of the chambers at the first end of the rotor in response to relative rotation between the rotor and the first head, and wherein each second fluid passage of the plurality of pressure exchangers is fluidly connected with the consecutively changing ones of the chambers at the second end of the rotor in response to the relative rotation between the rotor and the second head.

8. The method of claim 1 wherein coupling the plurality of pressure exchangers comprises coupling adjacent ones of the plurality of pressure exchangers by:

coupling the first heads of the adjacent pressure exchangers such that the first passages of the adjacent pressure exchangers are fluidly connected; and coupling the second heads of the adjacent pressure exchangers such that the second passages of the adjacent pressure exchangers are fluidly connected.

9. The method of claim 8 wherein the first and second passages of the adjacent pressure exchangers are fluidly connected in series.

10. The method of claim 8 wherein each first head further comprises a first fluid connector, wherein each second head further comprises a second fluid connector, wherein coupling the first heads of the adjacent pressure exchangers comprises operating the first fluid connector to couple the first heads of the adjacent pressure exchangers, and wherein coupling the second heads of the adjacent pressure exchangers comprises operating the second fluid connector to couple the second heads of the adjacent pressure exchangers.

11. The method of claim 10 wherein the first and second fluid connectors comprise flanges or threaded connectors.

12. The method of claim 8 wherein coupling the first heads of the adjacent pressure exchangers comprises connecting the first heads via a plurality of third tie rods extending through the first heads, and wherein coupling the second heads of the adjacent pressure exchangers comprises connecting the second heads via a plurality of fourth tie rods extending through the second heads.

13. The method of claim 8 further comprising replacing the selected one of the plurality of pressure exchangers with a new pressure exchanger by:

disconnecting the first head of the selected pressure exchanger from the first heads of adjacent ones of the plurality of pressure exchangers;

disconnecting the second head of the selected pressure exchanger from the second heads of the adjacent pressure exchangers;

removing the selected pressure exchanger;

inserting the new pressure exchanger between the adjacent pressure exchangers such that first and second heads of the new pressure exchanger are aligned with the first and second heads of the adjacent pressure exchangers;

connecting the first head of the new pressure exchanger with the first heads of the adjacent pressure exchangers; and connecting the second head of the new pressure exchanger with the second heads of the adjacent pressure exchangers.

14. The method of claim 13 wherein replacing the selected one of the plurality of pressure exchangers with the new pressure exchanger is performed while the adjacent pressure exchangers are maintained in a substantially constant position.

* * * * *